US011575208B2

(12) United States Patent
Tai et al.

(10) Patent No.: US 11,575,208 B2
(45) Date of Patent: Feb. 7, 2023

(54) ULTRA-WIDEBAND NON-METAL HORN ANTENNA

(71) Applicant: TMY Technology Inc., Taipei (TW)

(72) Inventors: Yang Tai, Hsinchu County (TW); Shun-Chung Kuo, Miaoli County (TW); Wen-Tsai Tsai, Hsinchu (TW); Jiun-Wei Wu, Taipei (TW); Shao-Chun Hsu, Taipei (TW)

(73) Assignee: TMY Technology Inc., Taipei (TW)

( * ) Notice: Subject to any disclaimer, the term of this patent is extended or adjusted under 35 U.S.C. 154(b) by 0 days.

(21) Appl. No.: 17/485,539

(22) Filed: Sep. 27, 2021

(65) Prior Publication Data

US 2022/0158353 A1 May 19, 2022

Related U.S. Application Data

(60) Provisional application No. 63/115,570, filed on Nov. 18, 2020.

(30) Foreign Application Priority Data

Apr. 23, 2021 (TW) ..... 110114721

(51) Int. Cl.
*H01Q 13/02* (2006.01)
*H01Q 5/25* (2015.01)

(52) U.S. Cl.
CPC ..... *H01Q 13/02* (2013.01); *H01Q 5/25* (2015.01)

(58) Field of Classification Search
CPC ..... H01Q 5/25; H01Q 19/08
See application file for complete search history.

(56) References Cited

U.S. PATENT DOCUMENTS 7,602,330 B2 * 10/2009 Serban ..... H01Q 13/02 342/124
8,242,965 B2 8/2012 Gerding et al.
(Continued)

FOREIGN PATENT DOCUMENTS

CN 103066391 4/2013
CN 107464992 A * 12/2017 ..... H01Q 1/36
(Continued)

OTHER PUBLICATIONS

"Search Report of Europe Counterpart Application", dated Dec. 14, 2021, pp. 1-5.
(Continued)

*Primary Examiner* — Dameon E Levi
*Assistant Examiner* — Anh N Ho
(74) *Attorney, Agent, or Firm* — JCIPRNET

(57) ABSTRACT

The disclosure provides an ultra-wideband non-metal horn antenna, which includes three combinable non-metal elements such as an impedance matching member, a field adjustment member and an outer cover member. The impedance matching member and the field adjustment member are respectively disposed with a first and second groove structures. The field adjustment member is connected between the impedance matching member and the outer cover member. Therefore, the horn antenna of the disclosure can have a more symmetrical radiation pattern, a smaller antenna size, and ultra-wideband performance.

20 Claims, 22 Drawing Sheets

(56) References Cited

U.S. PATENT DOCUMENTS

| | | | | |
|---|---|---|---|---|
| 8,354,970 | B2 * | 1/2013 | Armbrecht | H01Q 1/225 343/785 |
| 10,122,066 | B2 * | 11/2018 | Ito | G01S 7/03 |
| 10,476,166 | B2 | 11/2019 | Tuau et al. | |
| 10,897,084 | B2 * | 1/2021 | Saraf | H01Q 5/392 |
| 2006/0125705 | A1 | 6/2006 | Nagano | |
| 2010/0315310 | A1 | 12/2010 | Lin et al. | |

FOREIGN PATENT DOCUMENTS

| | | |
|---|---|---|
| CN | 105190991 | 8/2018 |
| TW | I301337 | 9/2008 |

OTHER PUBLICATIONS

H. Nakano et al., "A theoretical investigation of the two-wire round spiral antenna—Archimedian type," 1979 Antennas and Propagation Society International Symposium, Jun. 18-22, 1979, pp. 387-390.

M. Secmen et al., "A Dielectric Corrugated Feed Horn Antenna for Satellite Communication Applications," Microwave and Optical Technology Letters, vol. 52, No. 8, Aug. 2010, pp. 1709-1713.

A. J. Abumunshar et al., "5:1 Bandwidth Dielectric Rod Antenna Using a Novel Feed Structure," IEEE Transactions on Antennas and Propagation, vol. 65, No. 5, May 2017, pp. 1-8.

"Office Action of Taiwan Counterpart Application", dated Oct. 27, 2022, p. 1-p. 4.

* cited by examiner

ULTRA-WIDEBAND NON-METAL HORN ANTENNA

CROSS-REFERENCE TO RELATED APPLICATION

This application claims the priority benefit of U.S. provisional application Ser. No. 63/115,570, filed on Nov. 18, 2020, and Taiwan application Ser. No. 110114721, filed on Apr. 23, 2021. The entirety of each of the above-mentioned patent applications is hereby incorporated by reference herein and made a part of this specification.

BACKGROUND

Technical Field

The disclosure relates to an antenna structure, and particularly relates to an ultra-wideband non-metal horn antenna.

Description of Related Art

In known technology, although there is a way to achieve impedance matching between the waveguide tube and the feed horn antenna by configuring a mode matching part, but this method can only make adjustment to limited parameters, and it may be difficult to achieve impedance matching due to the overall structure of the feed horn antenna.

In addition, in known technology, there is also a method of adjusting the side lobe level and return loss by adjusting the development angle of the radiation section, but such design needs to be equipped with a longer launcher and the metal strip structure as the feed part, and therefore the overall size is large. Besides, the feeding method has poor performance in fixation, and is not suitable for commercialization.

SUMMARY

In view of this, the disclosure provides an ultra-wideband non-metal horn antenna, which can be used to solve the above technical problems.

The disclosure provides an ultra-wideband non-metal horn antenna, which includes an impedance matching member, a field adjustment member and an outer cover member. The impedance matching member includes a first end and a second end opposite to each other. The first end of the impedance matching member includes a first tenon portion, and the end surface of the second end of the impedance matching member is provided with a first recessed structure, wherein the first recessed structure includes a first protruding portion and a first groove structure surrounding the first protruding portion. The field adjustment member includes a first end and a second end opposite to each other. The end surface of the first end of the field adjustment member is provided with a first trench structure, and the end surface of the second end of the field adjustment member is provided with a second recessed structure, wherein the second recessed structure includes a second protruding portion and a second groove structure surrounding the second protruding portion, and the top surface of the second protruding portion is provided with a second trench structure corresponding to the first tenon portion. Moreover, the first tenon portion of the impedance matching member is inserted into the second trench structure of the field adjustment member. The outer cover member includes a first tapered structure and a second tenon portion corresponding to the first trench structure. The first tapered structure includes a vertex angle and a bottom surface. The second tenon portion is connected to the bottom surface of the first tapered structure, and the second tenon portion of the outer cover member is inserted into the first trench structure of the field adjustment member.

DESCRIPTION OF THE EMBODIMENTS

Figure 1:
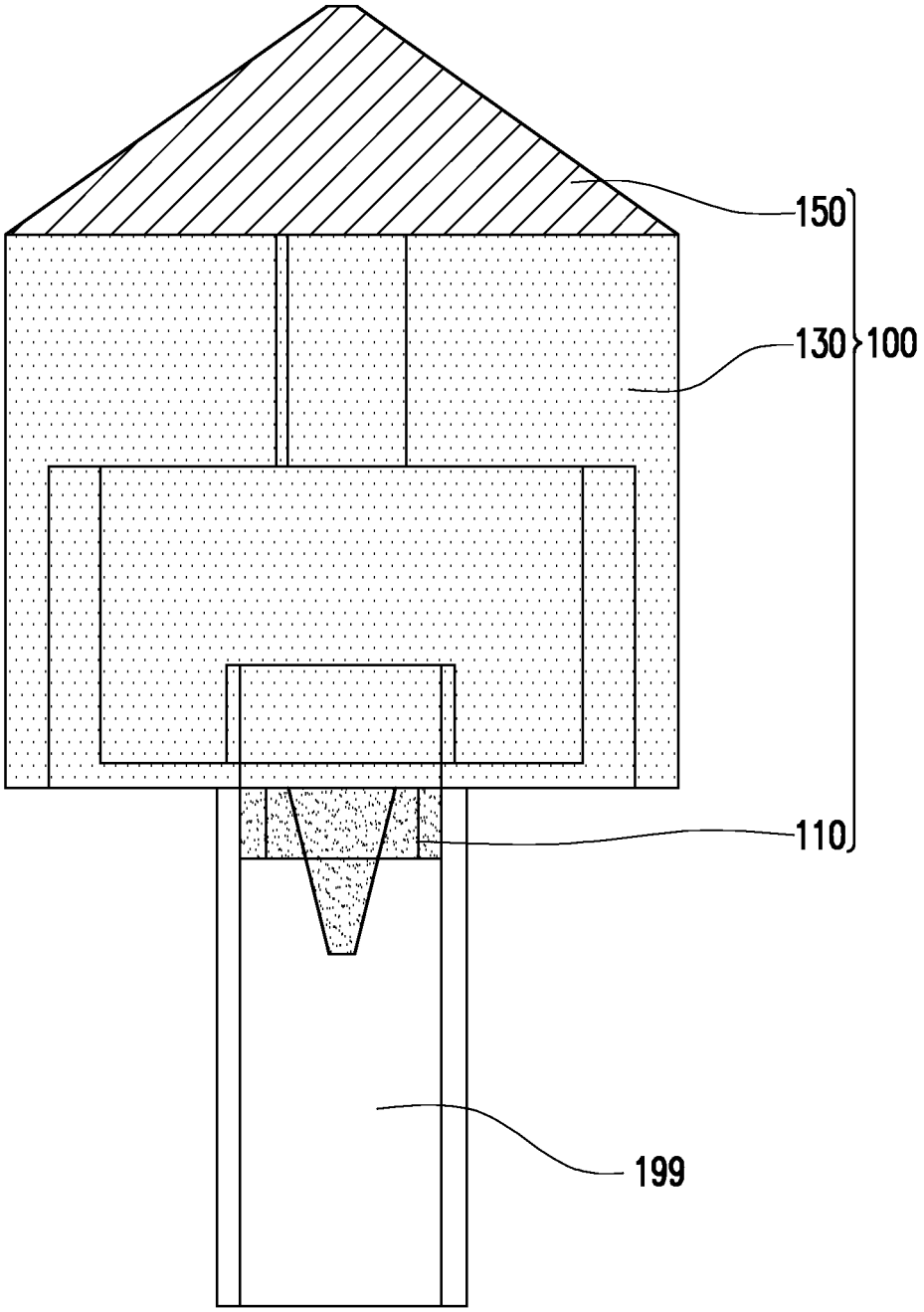
FIG. 1 is a schematic view of an ultra-wideband non-metal horn antenna connected with a waveguide tube according to an embodiment of the disclosure.

Please refer to FIG. 1, which is a schematic view of an ultra-wideband non-metal horn antenna connected with a waveguide tube according to an embodiment of the disclosure. In FIG. 1, the horn antenna 100 (i.e., ultra-wideband non-metal horn antenna) of the disclosure includes an impedance matching member 110, a field adjustment member 130, and an outer cover member 150, wherein the field adjustment member 130 is connected between the impedance matching member 110 and the outer cover member 150, and the horn antenna 100 is connected to the waveguide tube 199 through the impedance matching member 110. In the embodiment of the disclosure, the impedance matching member 110, the field adjustment member 130, the outer cover member 150 and the waveguide tube 199 can be realized by non-metal materials (but the outer layer of the waveguide tube 199 can be sputtered with a metal layer), and the following will further describe the structure of the impedance matching member 110, the field adjustment member 130, and the outer cover member 150 respectively.

Figure 2A:
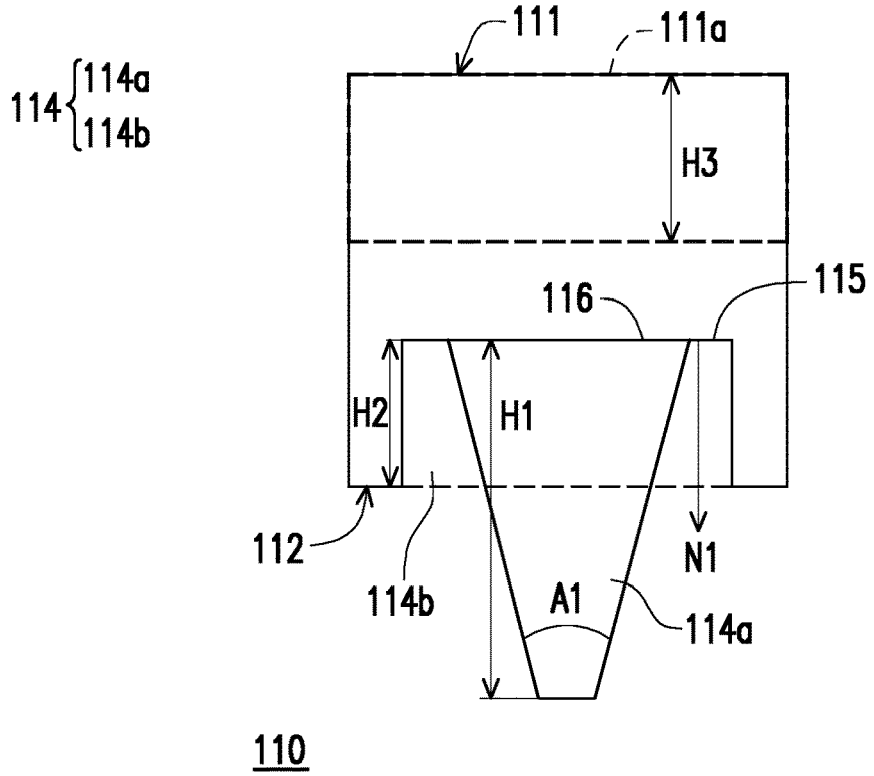
FIG. 2A is a side perspective view of the impedance matching member illustrated according to the first embodiment of the disclosure.
Figure 2B:
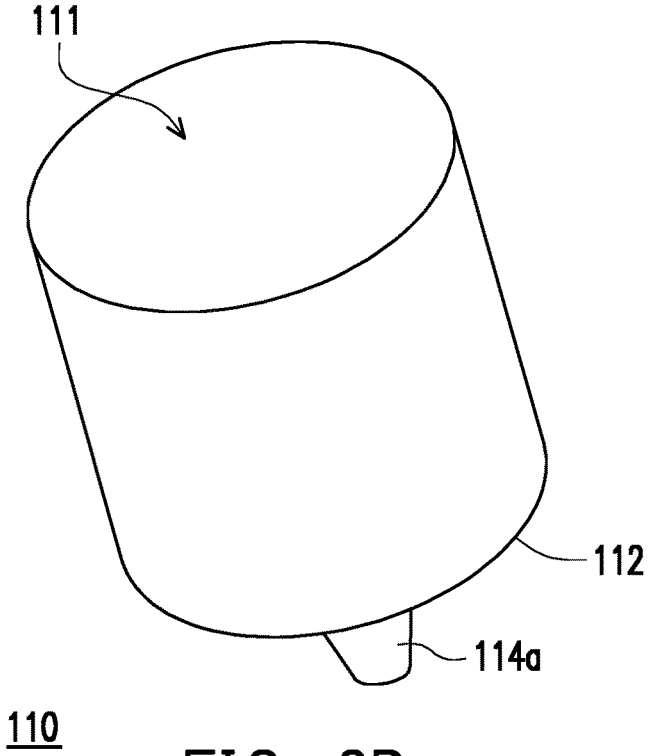
FIG. 2B is another view of the impedance matching member illustrated according to FIG. 2A.
Figure 2C:
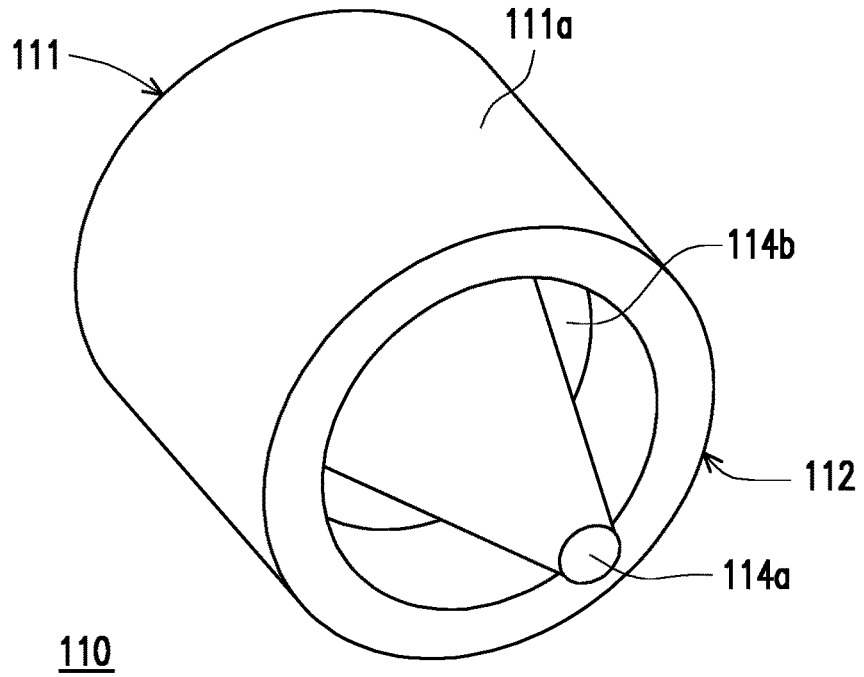
FIG. 2C is still another view of the impedance matching member illustrated according to FIG. 2A.

Please refer to FIG. 2A to FIG. 2C. FIG. 2A is a side perspective view of the impedance matching member illustrated according to the first embodiment of the disclosure, FIG. 2B is another view of the impedance matching member illustrated according to FIG. 2A, and FIG. 2C is still another view of the impedance matching member illustrated according to FIG. 2A.

In the first embodiment, the impedance matching member 110 is, for example, a cylindrical object, and may include a first end 111 and a second end 112 opposite to each other. The first end 111 of the impedance matching member 110 includes a first tenon portion 111*a*, and the end surface of the second end 112 of the impedance matching member 110 is provided with a first recessed structure 114.

As shown in FIG. 2A to FIG. 2C, the first recessed structure 114 may include a first protruding portion 114*a* and a first groove structure 114*b* surrounding the first protruding portion 114*a*. In an embodiment, the first recessed structure 114 may include a bottom surface 115, the first protruding portion 114*a* may include a bottom surface 116, and the bottom surface 116 of the first protruding portion 114*a* may be connected to the bottom surface 115 of the first recessed structure 114. In addition, the bottom surface 116 of the first protruding portion 114*a* may be disposed in the middle of the bottom surface 115 of the first recessed structure 114, but the disclosure is not limited thereto.

In some embodiments, the first protruding portion 114*a* may be a tapered structure in any form (for example, a cone, a polygonal pyramid, etc.), and the height H1 of the first protruding portion 114*a* may be greater than the depth H2 of the first groove structure 114*b*. In an embodiment, the horn antenna 100 can be, for example, configured to provide a radiation signal having a specific wavelength, and the height H1 of the first protruding portion 114*a* can be less than the specific wavelength, and the depth H2 of the first groove structure 114*b* can be less than half of the specific wavelength, but the disclosure is not limited thereto.

In FIG. 2A to FIG. 2C, the first protruding portion 114*a* further has a vertex angle A1 extending outward, and the vertex angle A1 may be between 13 degrees and 45 degrees. In an embodiment, the vertex angle A1 of the first protruding portion 114*a* can be regarded as extending toward the normal direction NI of the bottom surface 115 of the first recessed structure 114, but it may not be limited thereto.

In different embodiments, the sizes of the first protruding portion 114*a* and the first groove structure 114*b* can be adjusted according to the waveguide tube to be connected (for example, the waveguide tube 199 of FIG. 1), so as to achieve the purpose of impedance matching with the waveguide tube.

Figure 3:
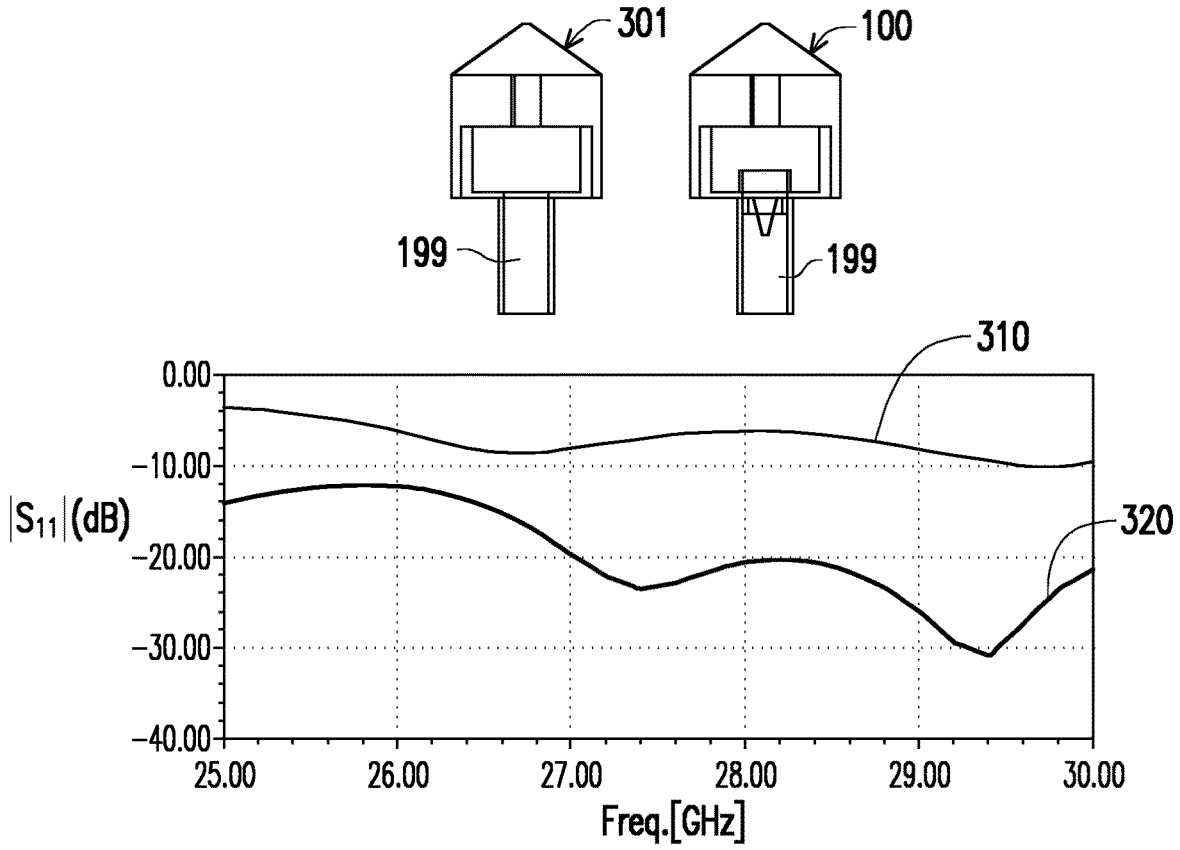
FIG. 3 is a comparison view of $|S_{11}|$ illustrated according to the first embodiment of the disclosure.

Referring to FIG. 3, FIG. 3 is a comparison view of $|S_{11}|$ illustrated according to the first embodiment of the disclosure. In FIG. 3, the horn antenna 301 is assembled by, for example, the field adjustment member 130 and the outer cover member 150 of FIG. 1. In other words, the horn antenna 301 can be regarded as a horn antenna in which the impedance matching member 110 of the horn antenna 100 in FIG. 1 is removed.

In this embodiment, the curves 310 and 320 are the return loss curves corresponding to the horn antennas 301 and 100, respectively. It can be seen from FIG. 3 that when the impedance matching member 110 is provided, the return loss (RL) of the horn antenna 100 is greater than 10 dB $|S_{11}|$ is lower than −10 dB), but which does not equally apply to the horn antenna 301 that is not provided with the impedance matching member 110. It can be seen that the impedance matching member 110 can effectively enable the horn antenna 100 and the waveguide tube 199 to achieve impedance matching effect.

Figure 4A:
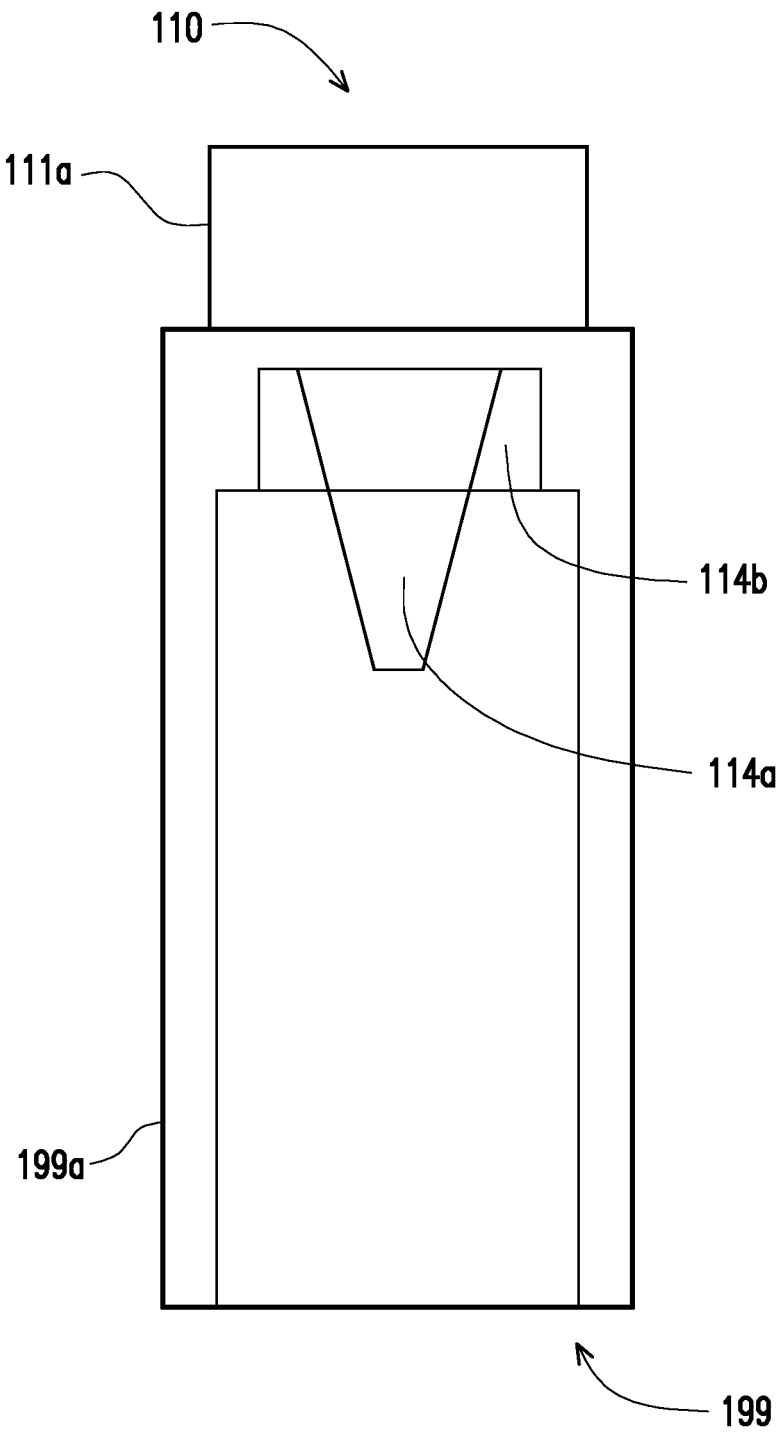
FIG. 4A is a side perspective view of the impedance matching member and the waveguide tube illustrated according to the second embodiment of the disclosure.
Figure 4B:
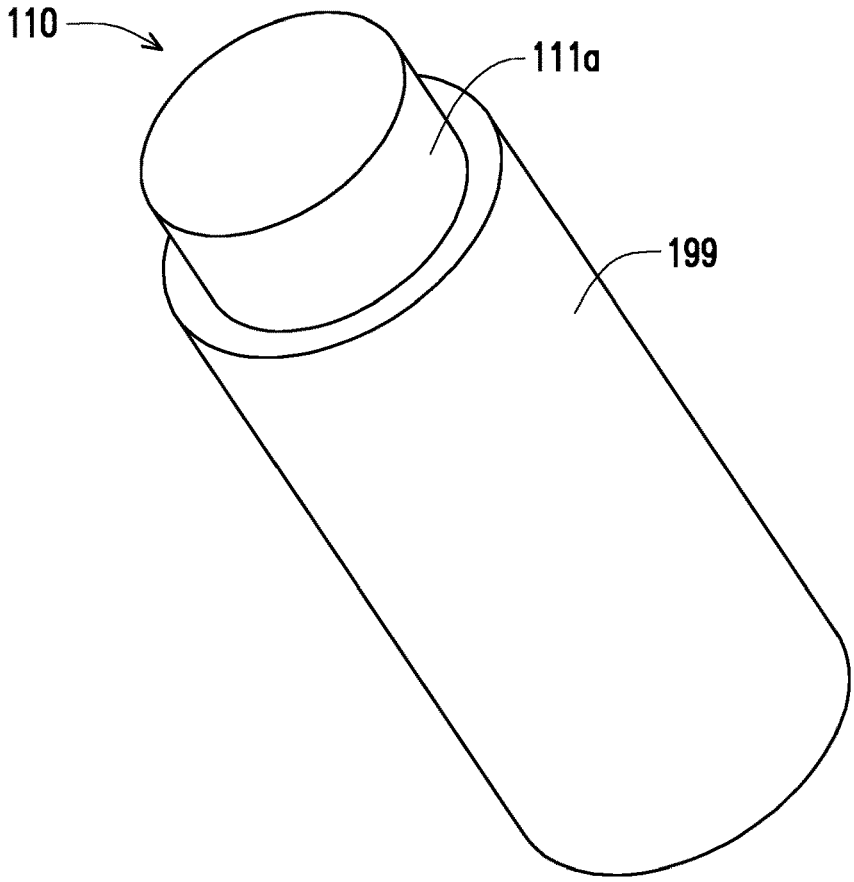
FIG. 4B is another view illustrated according to FIG. 4A.
Figure 4C:
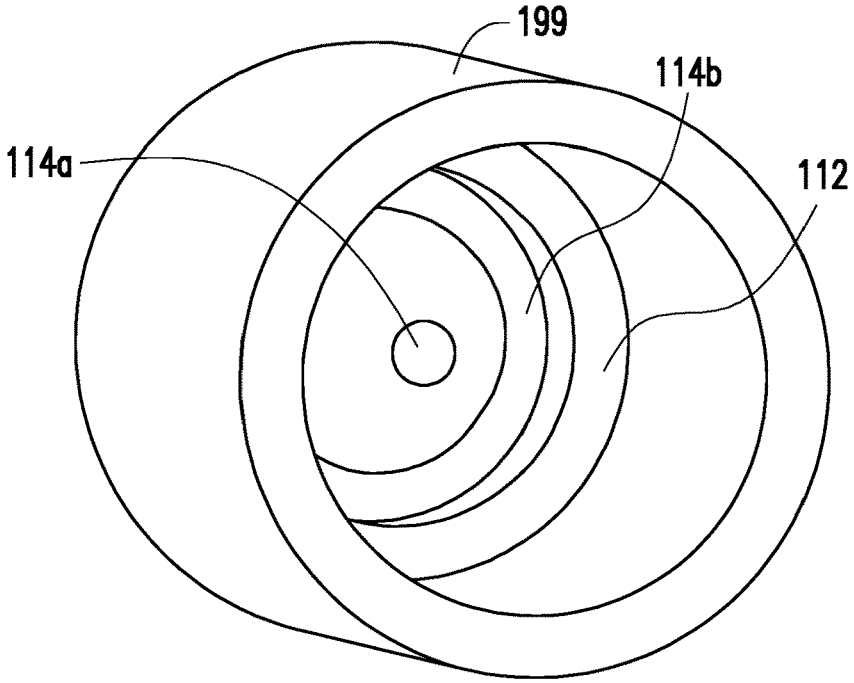
FIG. 4C is yet another view illustrated based on FIG. 4B.

Please refer to FIG. 4A to FIG. 4C. FIG. 4A is a side perspective view of the impedance matching member and the waveguide tube illustrated according to the second embodiment of the disclosure, FIG. 4B is another view illustrated according to FIG. 4A, and FIG. 4C is yet another view illustrated based on FIG. 4B. In the second embodiment, the impedance matching member 110 can be connected to the waveguide tube 199 through the second end 112. More specifically, the second end 112 of the impedance matching member 110 can be inserted into the waveguide tube 199 so that the impedance matching member 110 is connected to the waveguide tube 199, but the disclosure is not limited thereto.

In some embodiments, the waveguide tube 199 and the impedance matching member 110 may be integrally formed. In other embodiments, the waveguide tube 199 and the impedance matching member 110 may be designed to have a size that can be combined with each other. After forming, the outer layer of the waveguide tube 199 can be sputtered with a metal layer 199*a*, so as to achieve the effect of low cost and light weight.

Figure 5A:
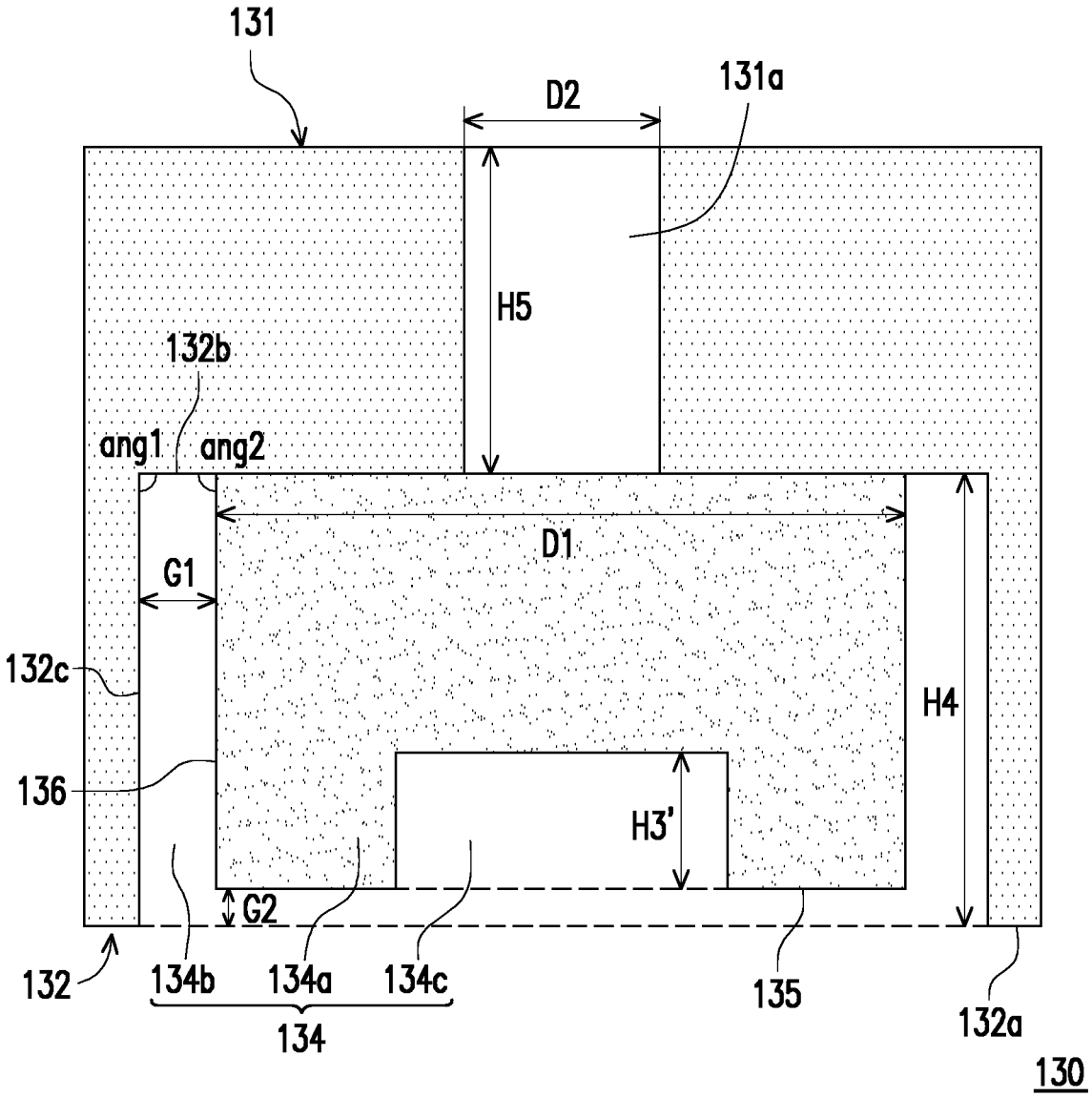
FIG. 5A is a side perspective view of a field adjustment member illustrated according to the third embodiment of the disclosure.
Figure 5B:
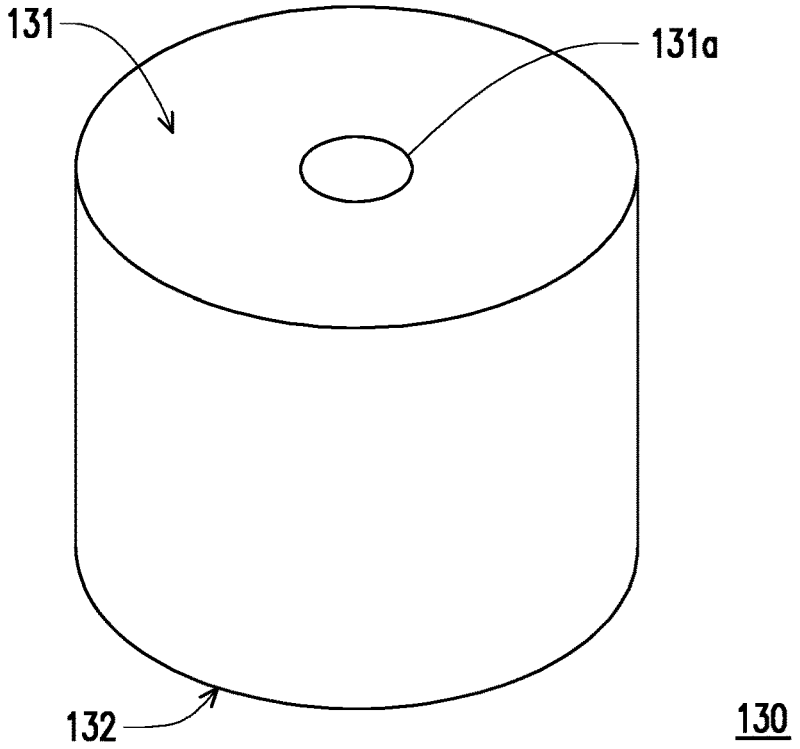
FIG. 5B is another view of the field adjustment member illustrated according to FIG. 5A.
Figure 5C:
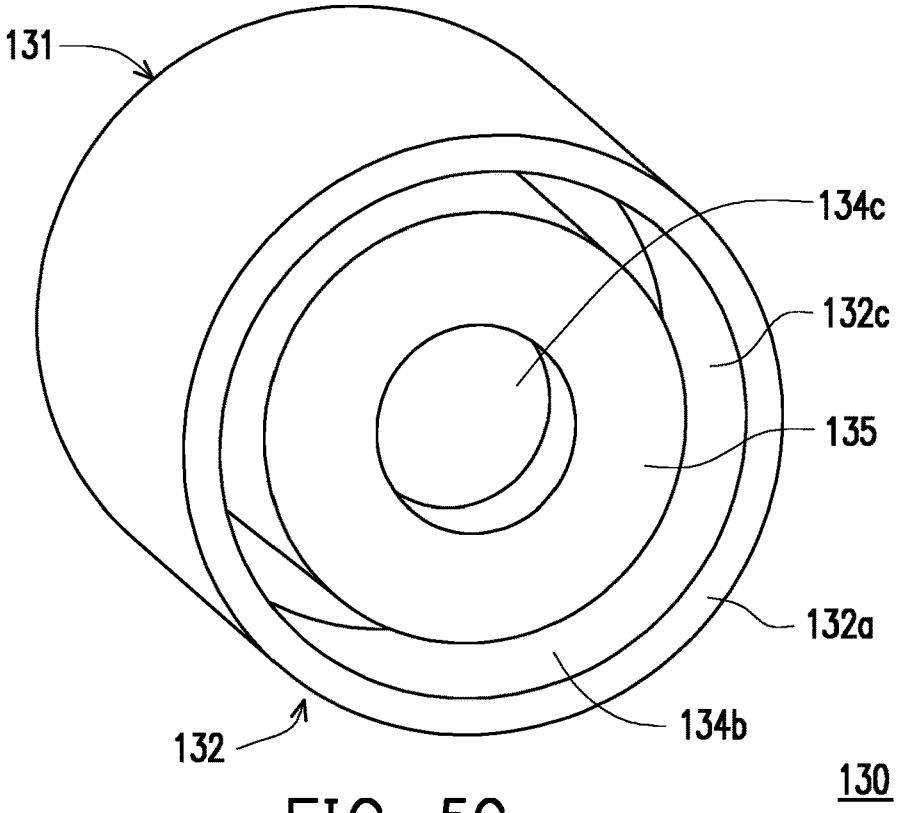
FIG. 5C is still another view of the field adjustment member illustrated according to FIG. 5B.

Referring to FIG. 5A to FIG. 5C, FIG. 5A is a side perspective view of a field adjustment member illustrated according to the third embodiment of the disclosure, FIG. 5B is another view of the field adjustment member illustrated according to FIG. 5A, and FIG. 5C is still another view of the field adjustment member illustrated according to FIG. 5B.

As shown in FIG. 5A to FIG. 5C, the field adjustment member 130 is, for example, a cylindrical object, which may include a first end 131 and a second end 132 opposite to each other. The end surface of the first end 131 of the field adjustment member 130 may be provided with a first trench structure 131*a* (which, for example, has a depth H5), and the end surface of the second end 132 of the field adjustment member 130 may be provided with a second recessed structure 134. In other embodiments, the field adjustment member 130 can also be designed as a prism-shaped object, but the disclosure is not limited thereto.

In the third embodiment, the second recessed structure 134 may include a second protruding portion 134*a* and a second groove structure 134*b* surrounding the second protruding portion 134*a*. In addition, the top surface 135 of the second protruding portion 134*a* may be provided with a second trench structure 134*c* corresponding to the first tenon portion 111*a*.

In the third embodiment, the first tenon portion 111*a* of the impedance matching member 110 can be inserted into the second trench structure 134*c* of the field adjustment member 130, so that the impedance matching member 110 can be connected to the field adjustment member 130 in the manner shown in FIG. 1. In addition, in order to allow the first tenon portion 111*a* to be inserted and fixed in the second trench structure 134*c*, the size of the first tenon portion 111*a* may be designed to correspond to the second trench structure 134*c*.

In some embodiments, the impedance matching member 110 and the field adjustment member 130 may be integrally formed, but may not be limited thereto.

In the third embodiment, the configuration of the second groove structure 134*b* (such as the diameter D1, depth H4, width G1, height difference G2, etc shown below) can be adjusted to improve the radiation pattern of the horn antenna 100, so that the horizontally polarized pattern and vertically polarized pattern are more symmetrical, thereby achieving the effect of narrow beam.

In an embodiment, the second trench structure 134*c* may have a depth H3', and the difference between the depth H3' of the second trench structure 134*c* and the height H3 of the first tenon portion 111*a* may be less than 0.5 mm.

In an embodiment, the second protruding portion 134*a* may be cylindrical, and the diameter D1 of the top surface 135 of the second protruding portion 134*a* may be between 1.1 times and 2 times the specific wavelength.

In an embodiment, the depth H4 of the second recessed structure 134 may be between 0.8 times and 1.5 times the specific wavelength.

In an embodiment, the width G1 of the second groove structure 134*b* may be between 0.5 mm and 0.4 times the specific wavelength.

In an embodiment, the second recessed structure 134 may have a top surface 132*a* and a bottom surface 132*b*. The bottom surface 132*b* of the second recessed structure 134 may be connected to the second protruding portion 134*a*. The height difference G2 between the top surface 132*a* of the second recessed structure 134 and the top surface 135 of the second protruding portions 134*a* may be less than 0.4 times the specific wavelength.

In addition, the second recessed structure 134 may further include an inner annular surface 132*c*, and the included angle ang1 between the inner annular surface 132*c* of the second recessed structure 134 and the bottom surface 132*b* of the second recessed structure 134 may be between 80 degrees and 100 degrees.

In an embodiment, the second protruding portion 134*a* may have an outer annular surface 136, and the included angle ang2 between the bottom surface 132*b* of the second recessed structure 134 and the outer annular surface 136 of the second protruding portion 134*a* may be between 80 degrees and 100 degrees.

In an embodiment, the second groove structure 134*b* may be a circular structure or a polygonal structure other than a regular triangle (for example, a regular quadrilateral, a regular pentagon, etc.). In this way, the radiation energy can be made more even, and therefore it is easier to design a laterally symmetrical radiation pattern.

Figure 6A:
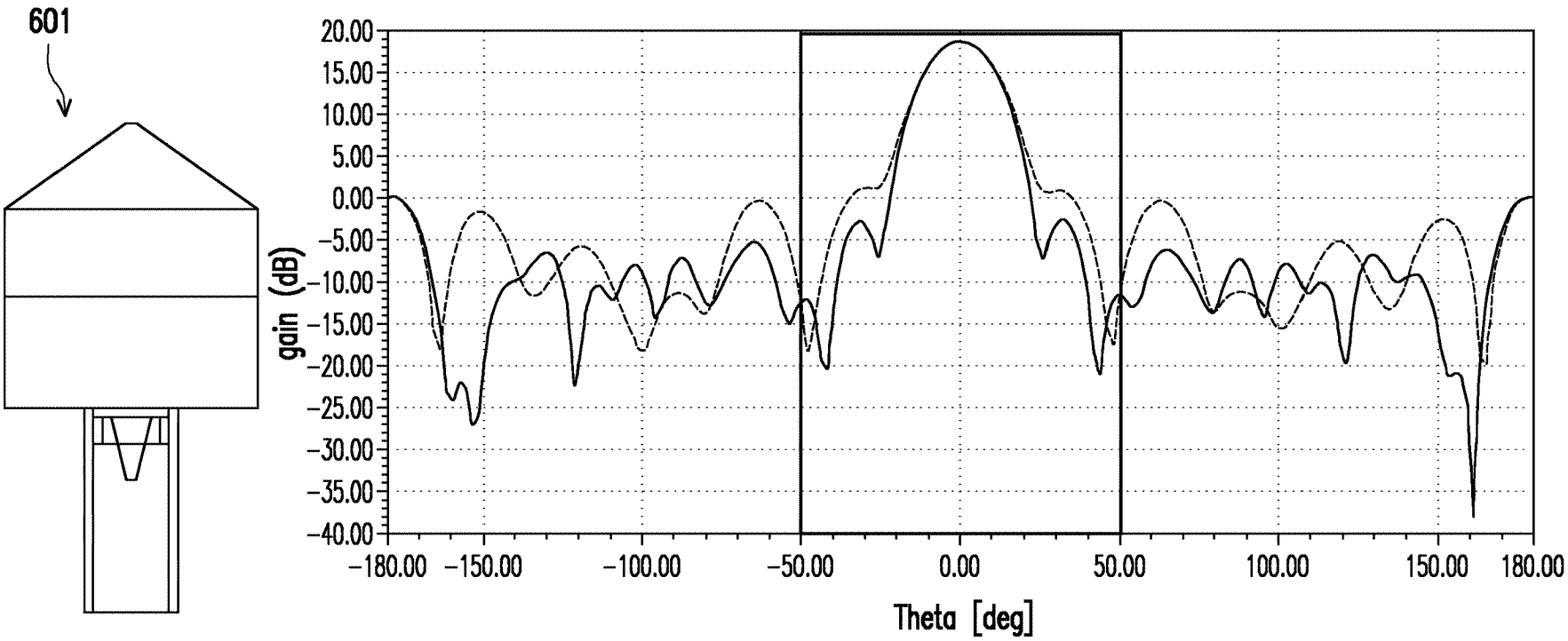
FIG. 6A is a radiation pattern diagram of a horn antenna without a second groove structure.
Figure 6B:
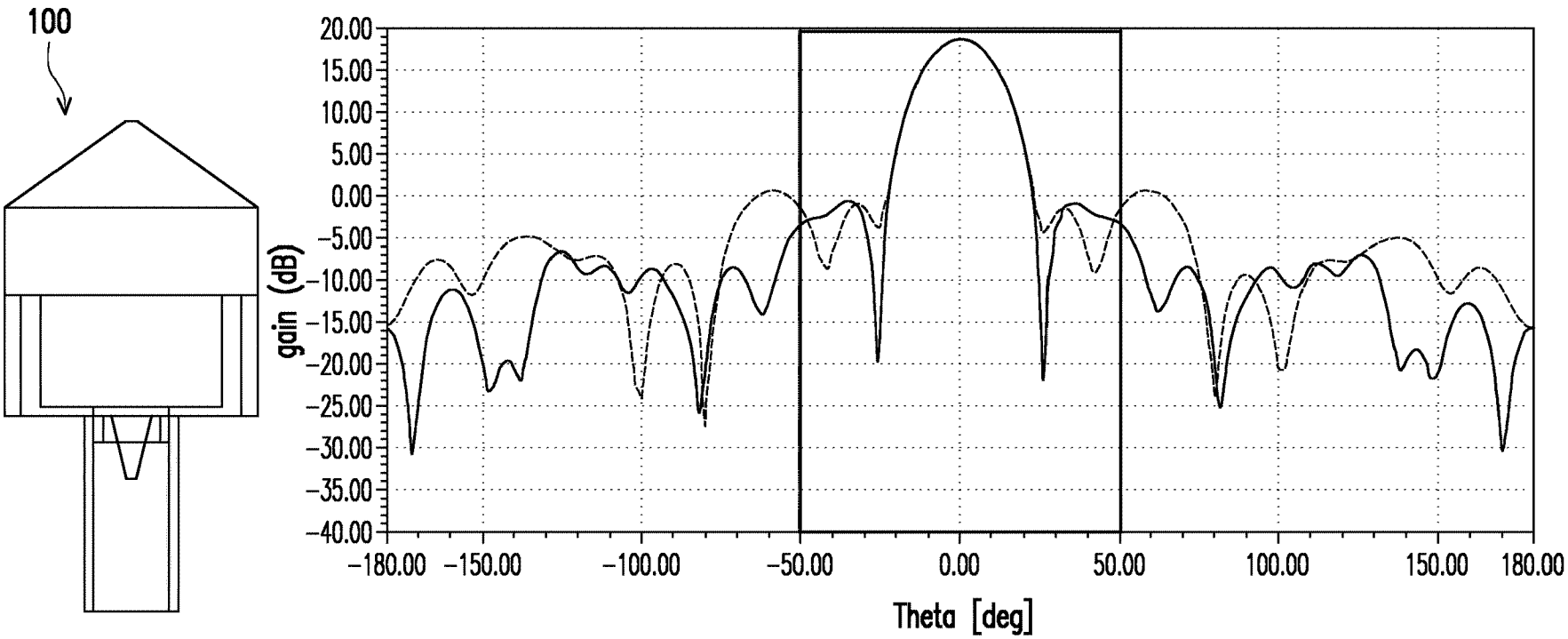
FIG. 6B is a radiation pattern diagram of a horn antenna provided with a second groove structure.

Referring to FIG. 6A and FIG. 6B, FIG. 6A is a radiation pattern diagram of a horn antenna without a second groove structure, and FIG. 6B is a radiation pattern diagram of a horn antenna provided with a second groove structure. In FIG. 6A, the antenna structure 601 can be regarded as an antenna structure obtained by removing the second groove structure 134*b* in the horn antenna 100 of FIG. 6B.

In FIG. 6A and FIG. 6B, the solid line is, for example, a horizontally polarized radiation pattern, and the dashed line is, for example, a vertically polarized radiation pattern. Comparing FIG. 6A with FIG. 6B, it can be seen that the radiation pattern in FIG. 6B is more symmetrical, and the side lobes are also lower. Therefore, it can be obtained that the horn antenna 100 provided with the second groove structure 134*b* can indeed improve the radiation pattern.

Figure 7A:
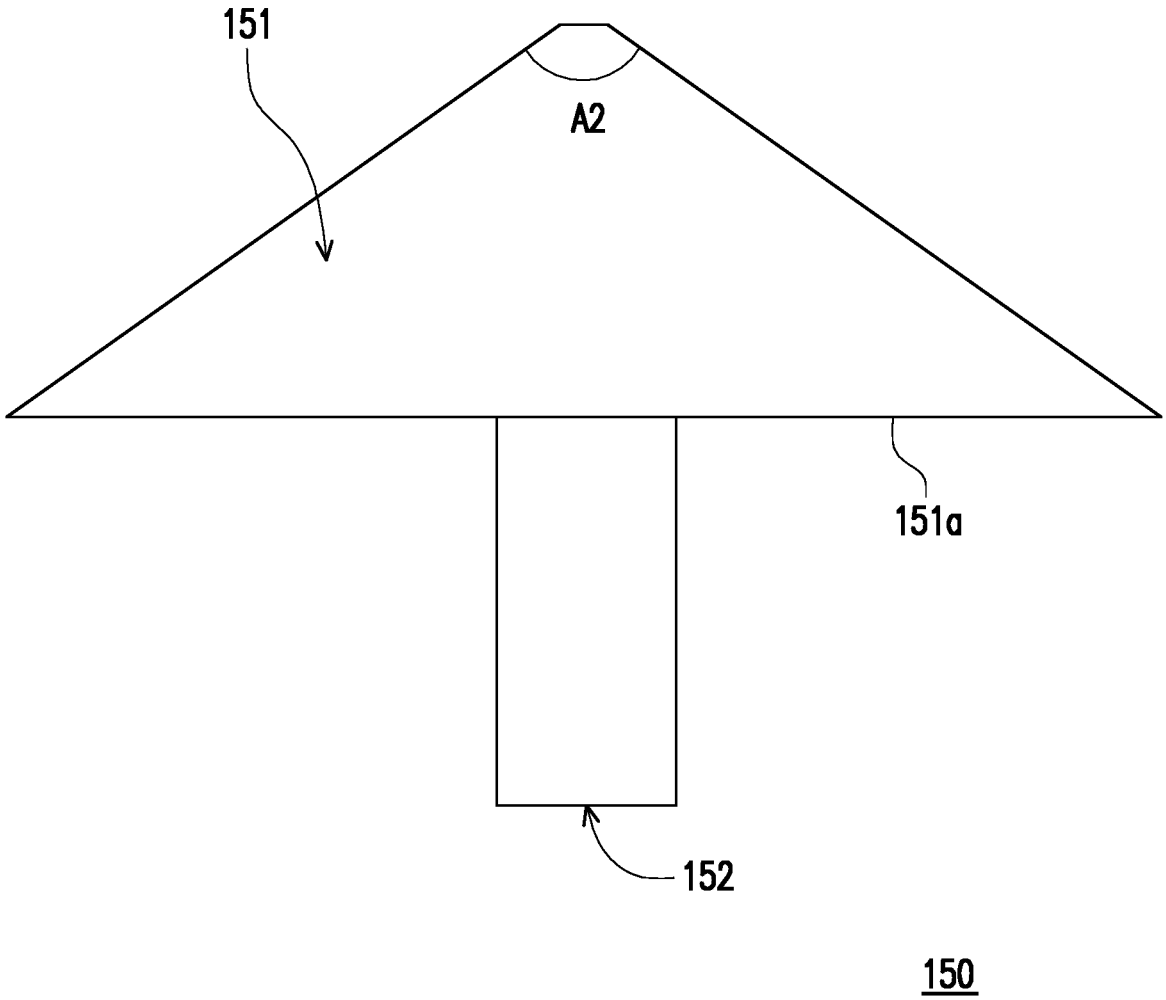
FIG. 7A is a side view of the outer cover member illustrated according to the fourth embodiment of the disclosure.
Figure 7B:
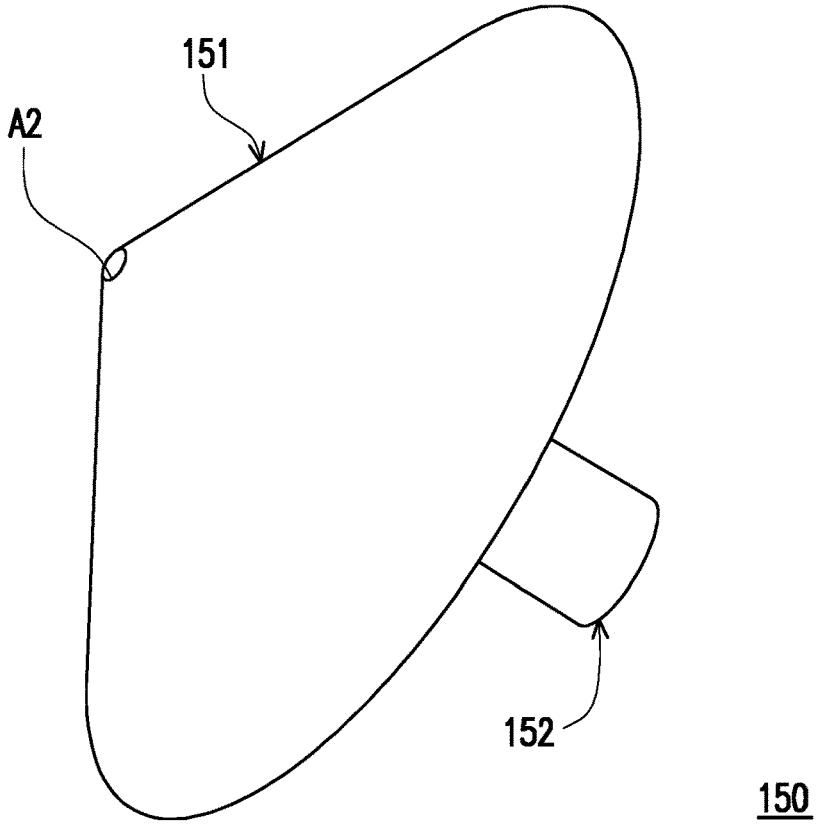
FIG. 7B is another view of the outer cover member illustrated according to FIG. 7A.
Figure 7C:
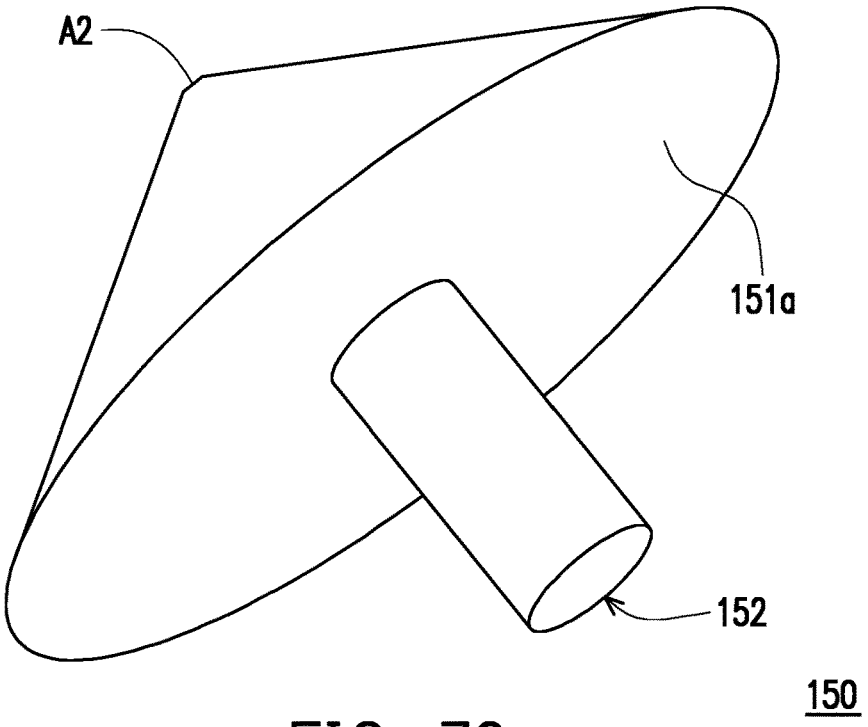
FIG. 7C is yet another view of the outer cover member illustrated according to FIG. 7A.

Referring to FIG. 7A to FIG. 7C, FIG. 7A is a side view of the outer cover member illustrated according to the fourth embodiment of the disclosure, FIG. 7B is another view of the outer cover member illustrated according to FIG. 7A, and FIG. 7C is yet another view of the outer cover member illustrated according to FIG. 7A.

As shown in FIG. 7A to FIG. 7C, the outer cover member 150 may include a first tapered structure 151 and a second tenon portion 152 corresponding to the first trench structure 131*a*, wherein the length of the second tenon portion 152 may be less than or equal to the depth H5 of the first trench structure 131*a*. The first tapered structure 151 is, for example, a cone-shaped object, which may include a vertex angle A2 and a bottom surface 151*a*, wherein one end of the second tenon portion 152 can be connected to the bottom surface 151*a* of the first tapered structure 151, and the other end of the second tenon portion 152 can be inserted into the first trench structure 131*a* of the field adjustment member 130, so that the outer cover member 150 can be connected to the field adjustment member 130 in the manner shown in FIG. 1. In addition, in other embodiments, the first tapered structure 151 can also be implemented as a pyramidal object, but it may not be limited thereto.

In an embodiment, in order to enable the second tenon portion 152 to be inserted and fixed in the first trench structure 131*a*, the size of the second tenon portion 152 may be designed to correspond to the first trench structure 131*a*. In addition, one end of the second tenon portion 152 can be connected to the middle of the bottom surface 151*a* of the first tapered structure 151, and the area of the bottom surface 151*a* of the first tapered structure 151 can match the area of the end surface of the first end 131 of the field adjustment member 130. In this way, unevenness in the connection between the outer cover member 150 and the field adjustment member 130 can be avoided.

In the embodiment of the disclosure, the first tapered structure 151 of the outer cover member 150 can be used to suppress side lobes and back lobes in the radiation pattern and increase the radiation gain. In addition, realizing the outer cover member 150 with a material with a higher dielectric coefficient can further achieve the effect of narrow beams.

In an embodiment, the vertex angle A2 of the first tapered structure 151 may be between 90 degrees and 120 degrees to effectively suppress the side lobes and the back lobes. In addition, the first tapered structure 151 may be a cone structure or a regular polygonal cone structure (for example, a regular triangle, a regular tetragon, a regular pentagon, etc.).

In some embodiments, when the field adjustment member 130 is designed as a regular N-sided angular columnar object, the first tapered structure 151 can also be correspondingly designed as a regular N-sided angular pyramidal object, wherein N is a positive integer greater than or equal to 3, for example.

In an embodiment, when the shrinkage rate of the material is low, the impedance matching member 110, the field adjustment member 130 and the outer cover member 150 may be integrally formed. In addition, when the shrinkage rate of the material is high, the impedance matching member 110, the field adjustment member 130 and the outer cover member 150 can be realized as separate parts.

Figure 8A:
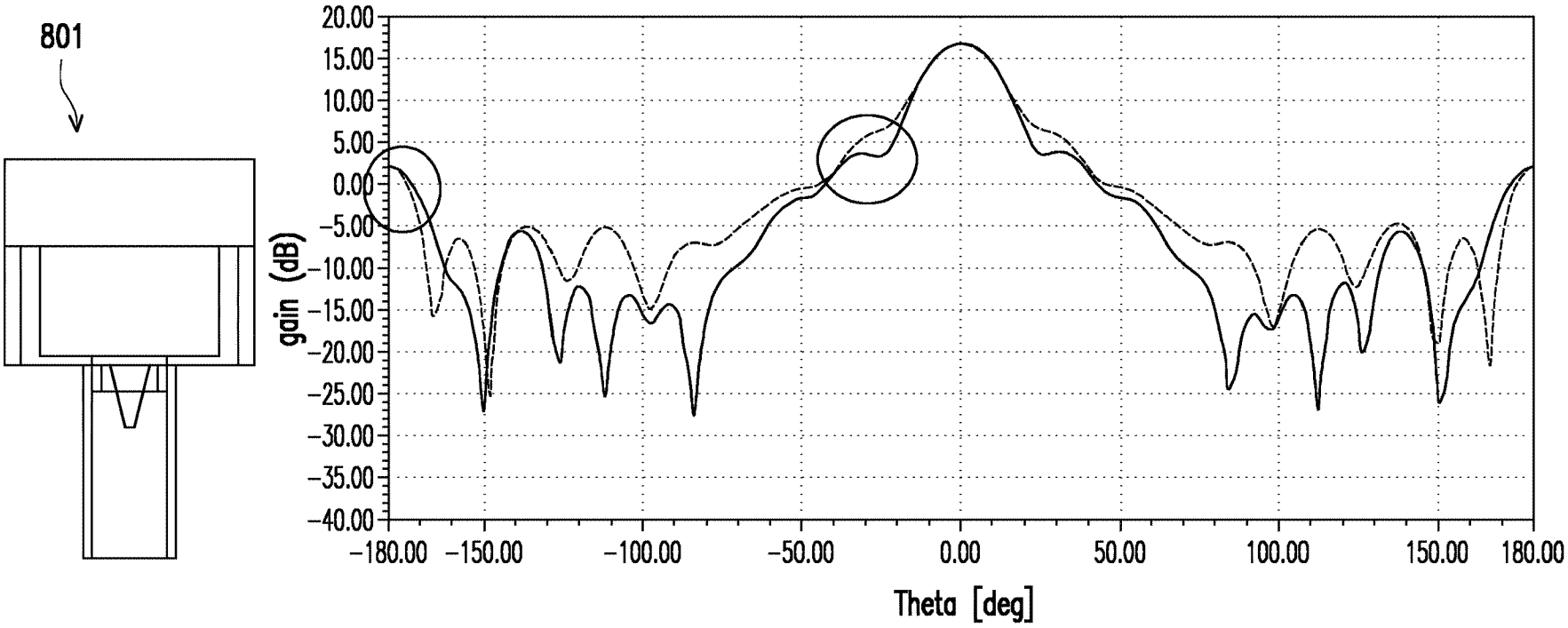
FIG. 8A is a radiation pattern diagram of a horn antenna without an outer cover member.
Figure 8B:
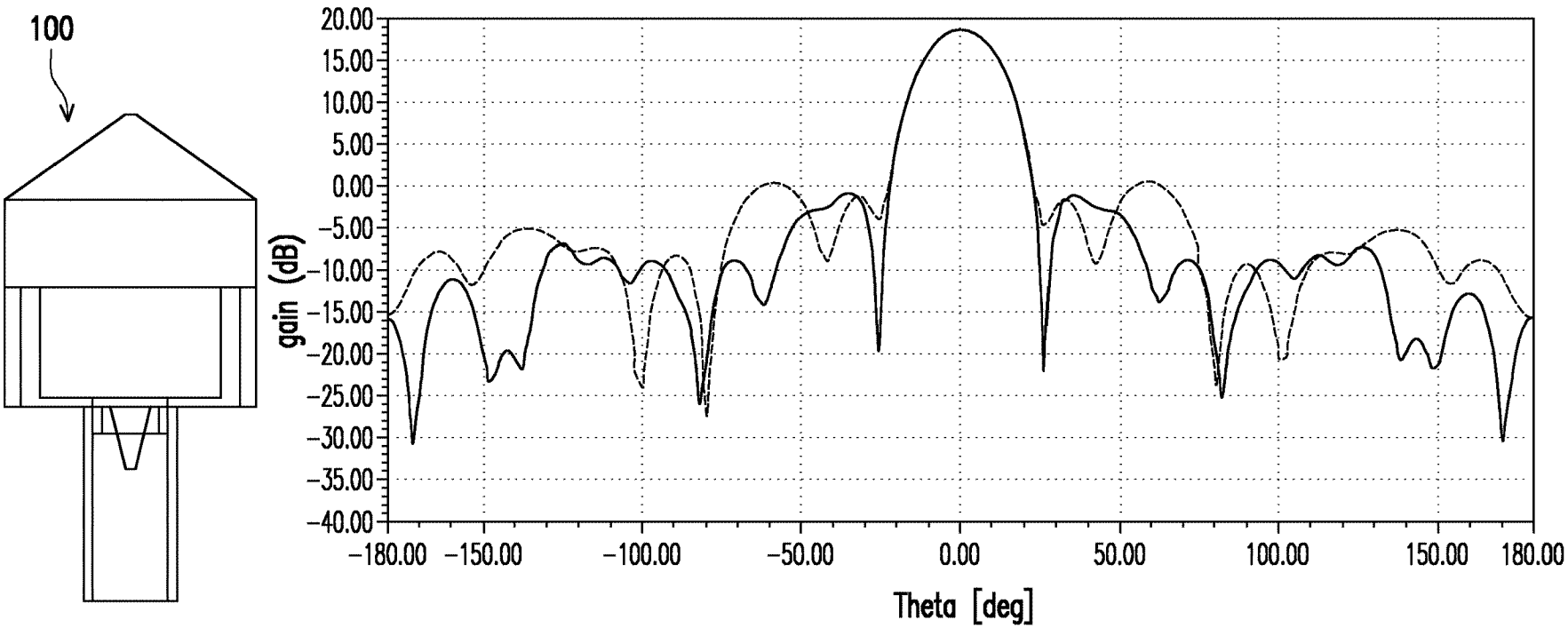
FIG. 8B is a radiation pattern diagram of a horn antenna provided with an outer cover member.

Please refer to FIG. 8A and FIG. 8B. FIG. 8A is a radiation pattern diagram of a horn antenna without an outer cover member, and FIG. 8B is a radiation pattern diagram of a horn antenna provided with an outer cover member. In FIG. 8A, the antenna structure 801 can be regarded as an antenna structure in which the outer cover member 150 in the horn antenna 100 of FIG. 8B is removed.

In FIG. 8A and FIG. 8B, the solid line is, for example, a horizontally polarized radiation pattern, and the dashed line is, for example, a vertically polarized radiation pattern. Comparing FIG. 8A with FIG. 8B, it can be seen that the side lobes and back lobes in FIG. 8B are relatively low. Therefore, it can be obtained that the horn antenna 100 provided with the outer cover member 150 can indeed effectively suppress the side lobes and back lobes.

Figure 9A:
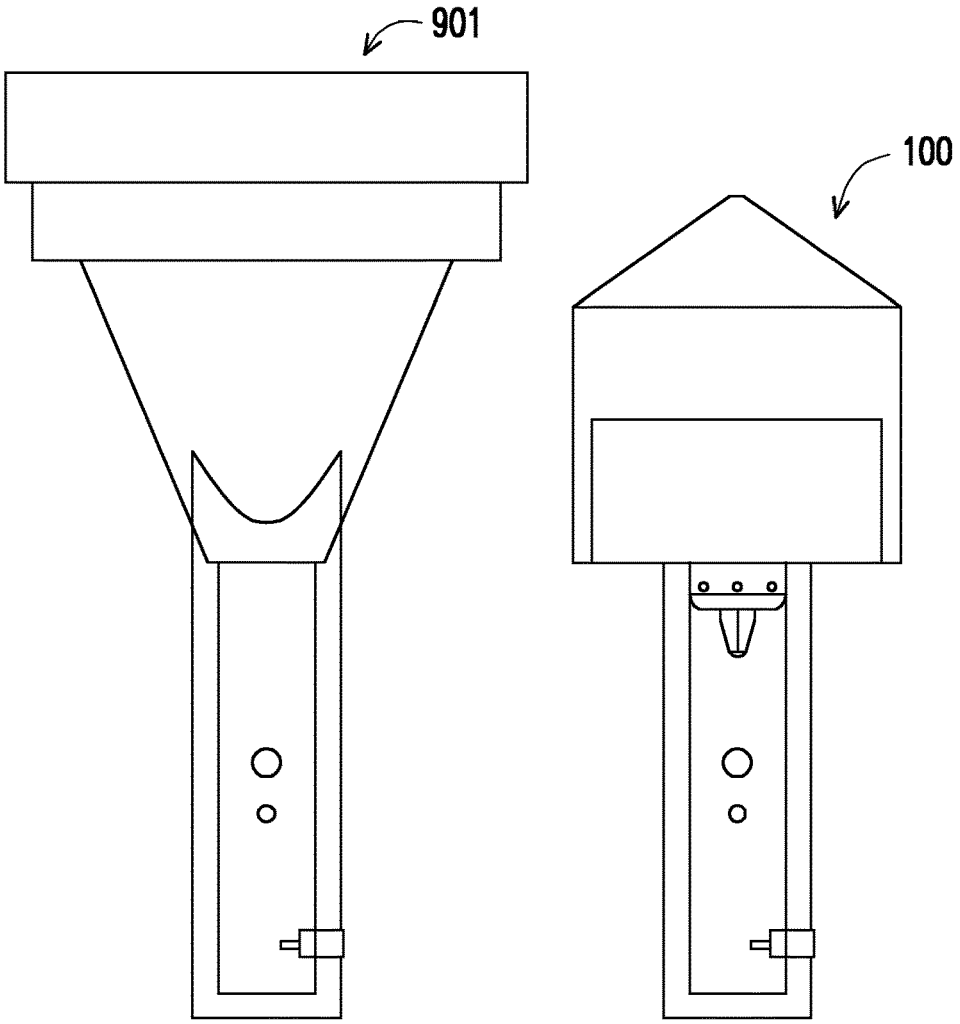
FIG. 9A is a side view of the conventional horn antenna and the horn antenna of the disclosure.
Figure 9B:
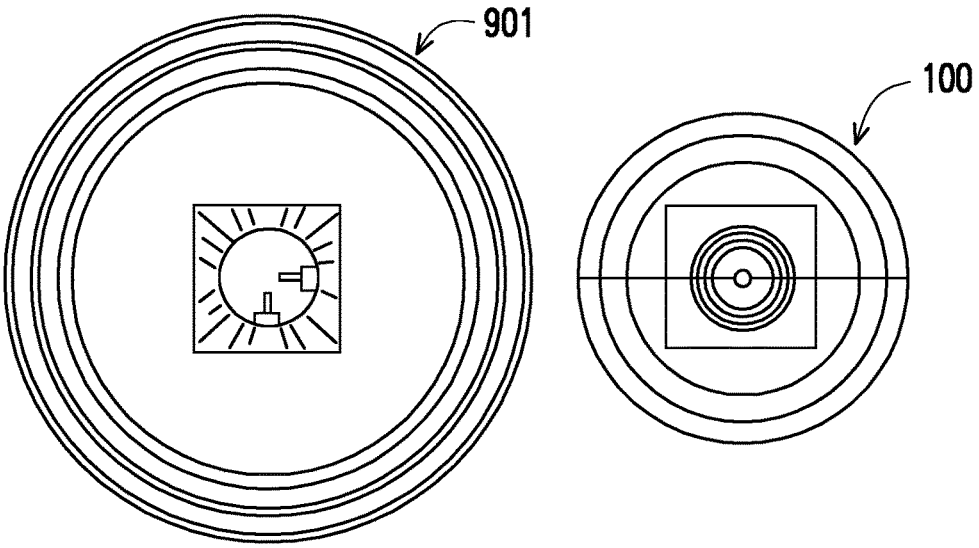
FIG. 9B is a top view of the conventional horn antenna and the horn antenna of the disclosure illustrated according to FIG. 9A.
Figure 9C:
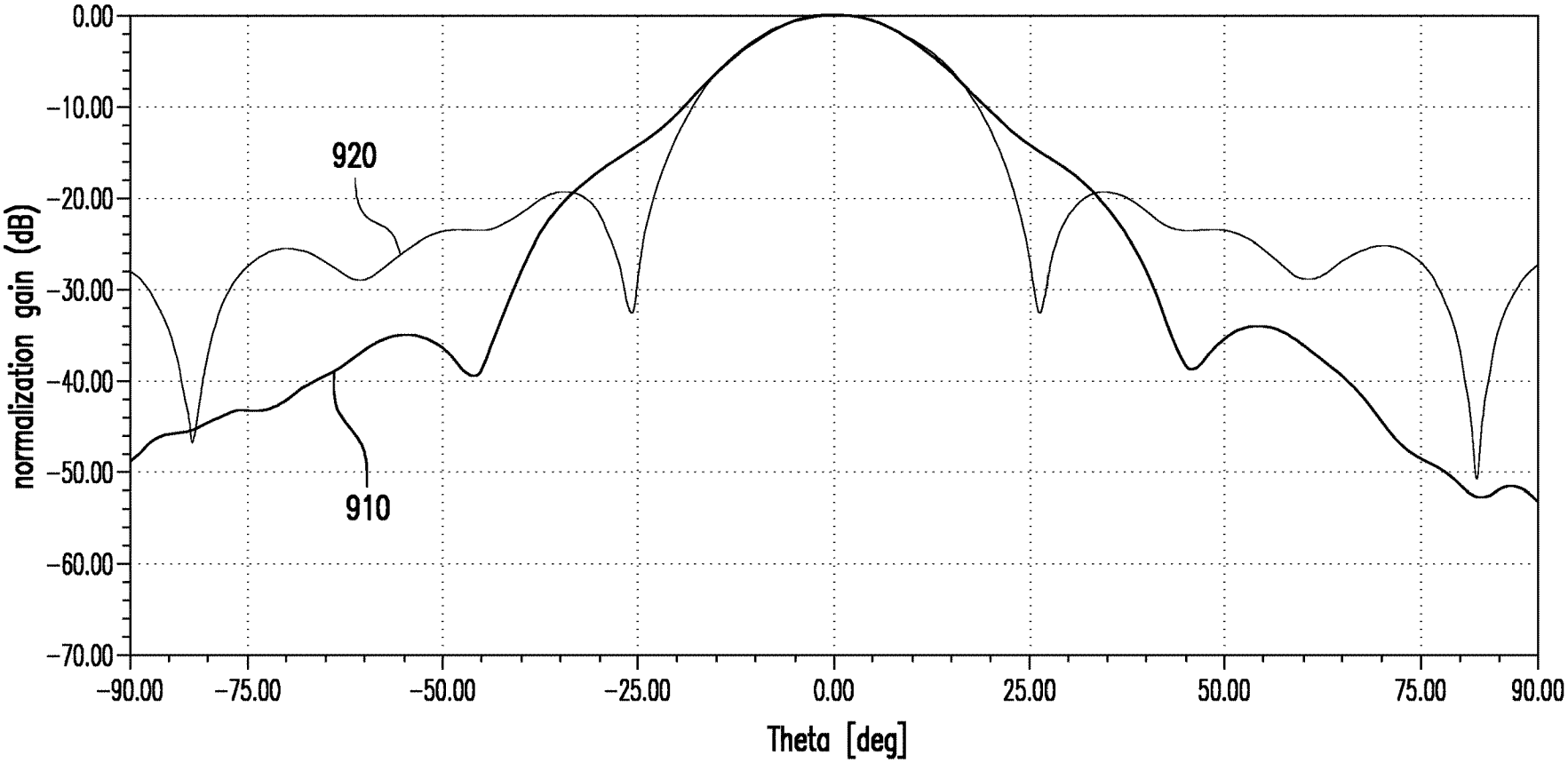
FIG. 9C is a radiation pattern diagram illustrated according to FIG. 9A.
Figure 9D:
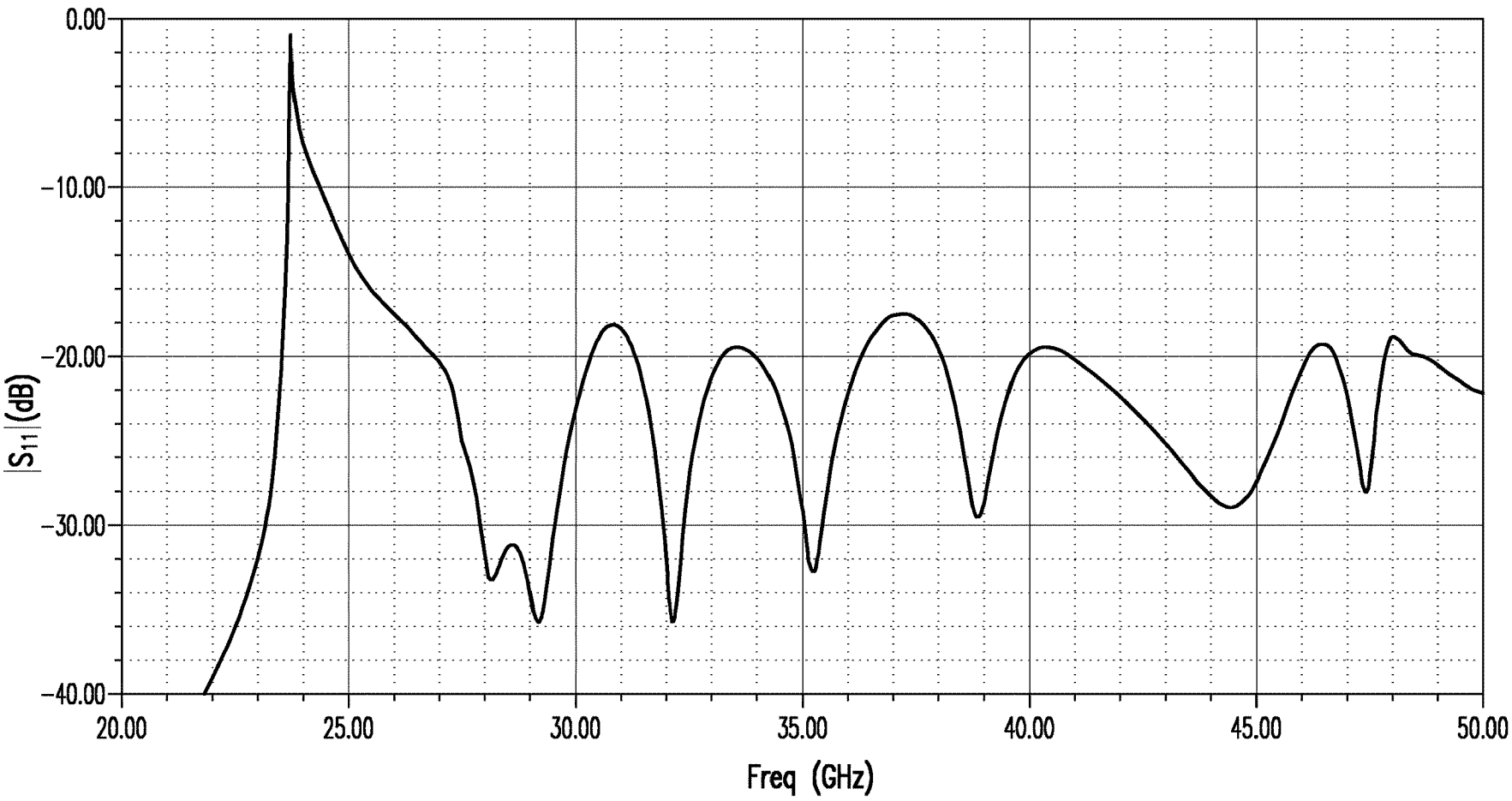
FIG. 9D is a reflection coefficient diagram illustrated according to FIG. 9A.

Please refer to FIG. 9A to FIG. 9D. FIG. 9A is a side view of the conventional horn antenna and the horn antenna of the disclosure, FIG. 9B is a top view of the conventional horn antenna and the horn antenna of the disclosure illustrated according to FIG. 9A, FIG. 9C is a radiation pattern diagram illustrated according to FIG. 9A, and FIG. 9D is a reflection coefficient diagram illustrated according to FIG. 9A. In FIG. 9A and FIG. 9B, the horn antenna 901 is, for example, a conventional metal horn antenna provided with a mode matching part. In FIG. 9C, curves 910 and 920 correspond to horn antennas 901 and 100, respectively.

It can be seen from FIG. 9A to FIG. 9D that under the bandwidth with the same 10 dB beamwidth, the size of the horn antenna 100 of the disclosure is only about 50% of the size of the horn antenna 901, and the radiation pattern is also relatively concentrated. In addition, it is also possible to achieve ultra-wideband characteristics (reflection coefficient less than −10 dB).

In different embodiments, the impedance matching member 110, the field adjustment member 130, and the outer cover member 150 of the disclosure can be realized by using the same non-metal material, wherein the dielectric coefficient of the non-metal material can be between 2 and 16.

Figure 10A:
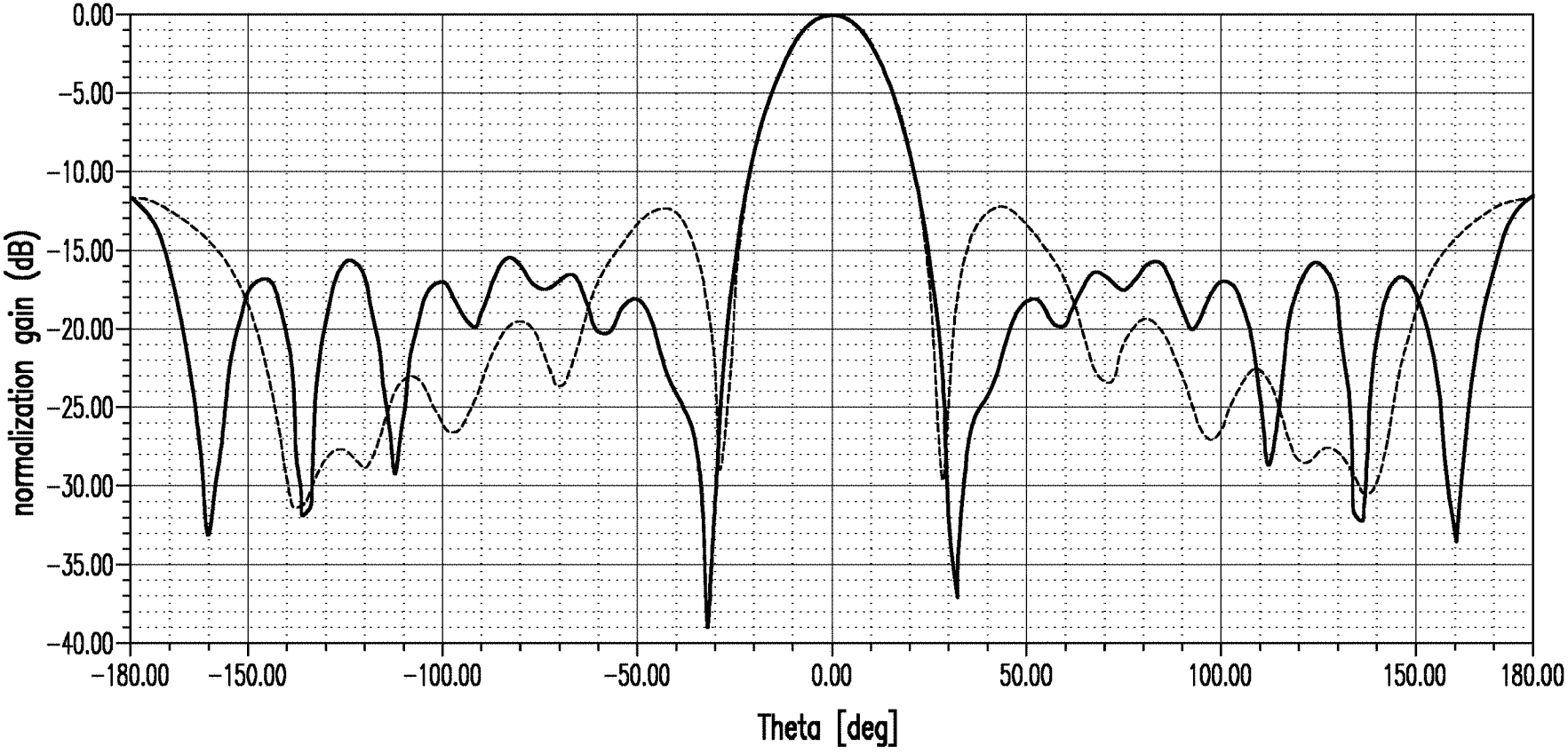
FIG. 10A is a horizontally and vertically polarized radiation pattern diagram illustrated according to an embodiment of the disclosure.
Figure 10B:
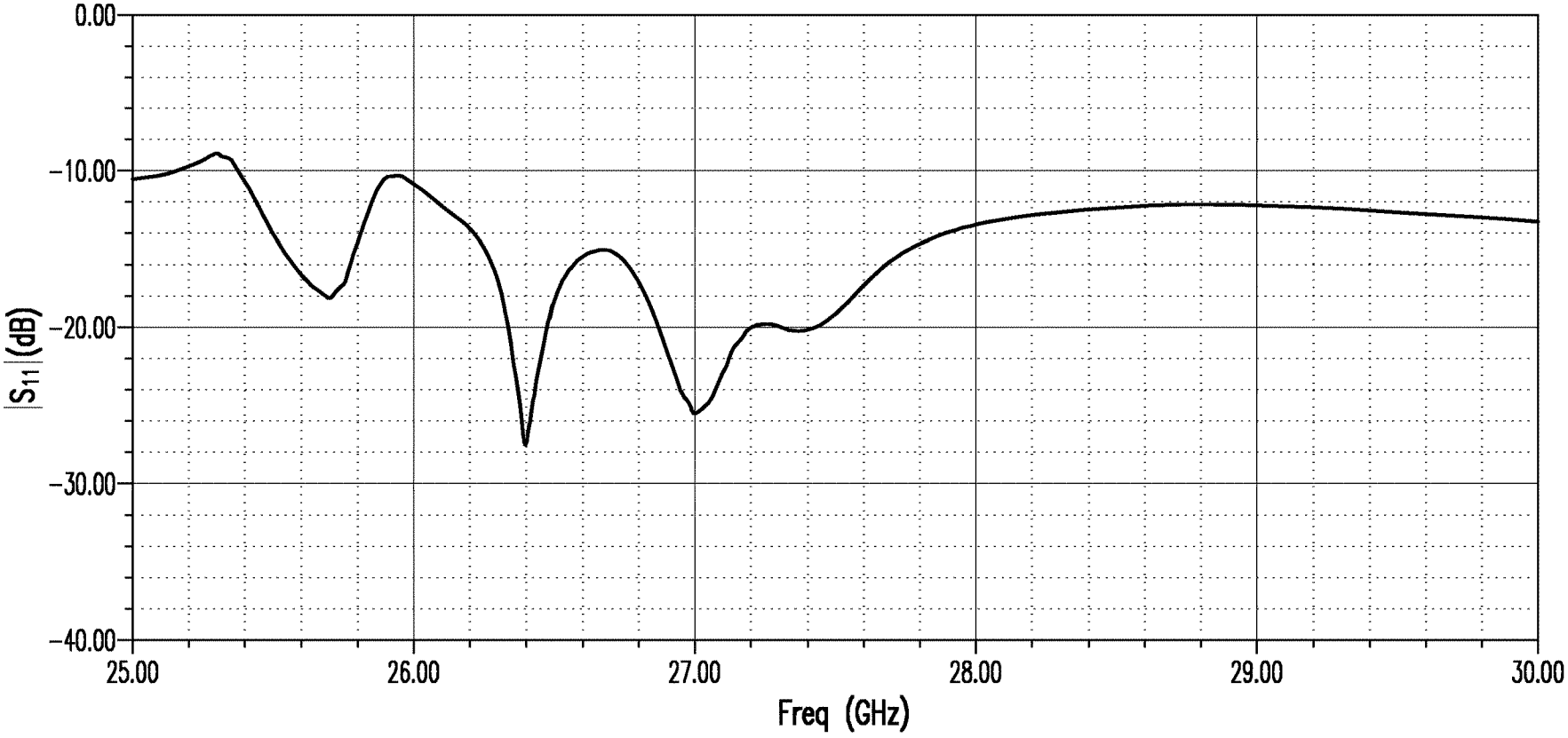
FIG. 10B is a reflection coefficient diagram illustrated according to FIG. 10A.

Please refer to FIG. 10A and FIG. 10B. FIG. 10A is a horizontally and vertically polarized radiation pattern diagram illustrated according to an embodiment of the disclosure. FIG. 10B is a reflection coefficient diagram illustrated according to FIG. 10A. In this embodiment, the impedance matching member 110, the field adjustment member 130, and the outer cover member 150 are assumed to be implemented by using non-metal materials with a dielectric coefficient of 10.2. It can be seen from FIG. 10A and FIG. 10B that in the case of using non-metal materials with a dielectric coefficient of 10.2 to implement the impedance matching member 110, the field adjustment member 130, and the outer cover member 150, the horizontally and vertically polarized patterns can be symmetrical and also have the ultra-wideband effect.

Figure 11:
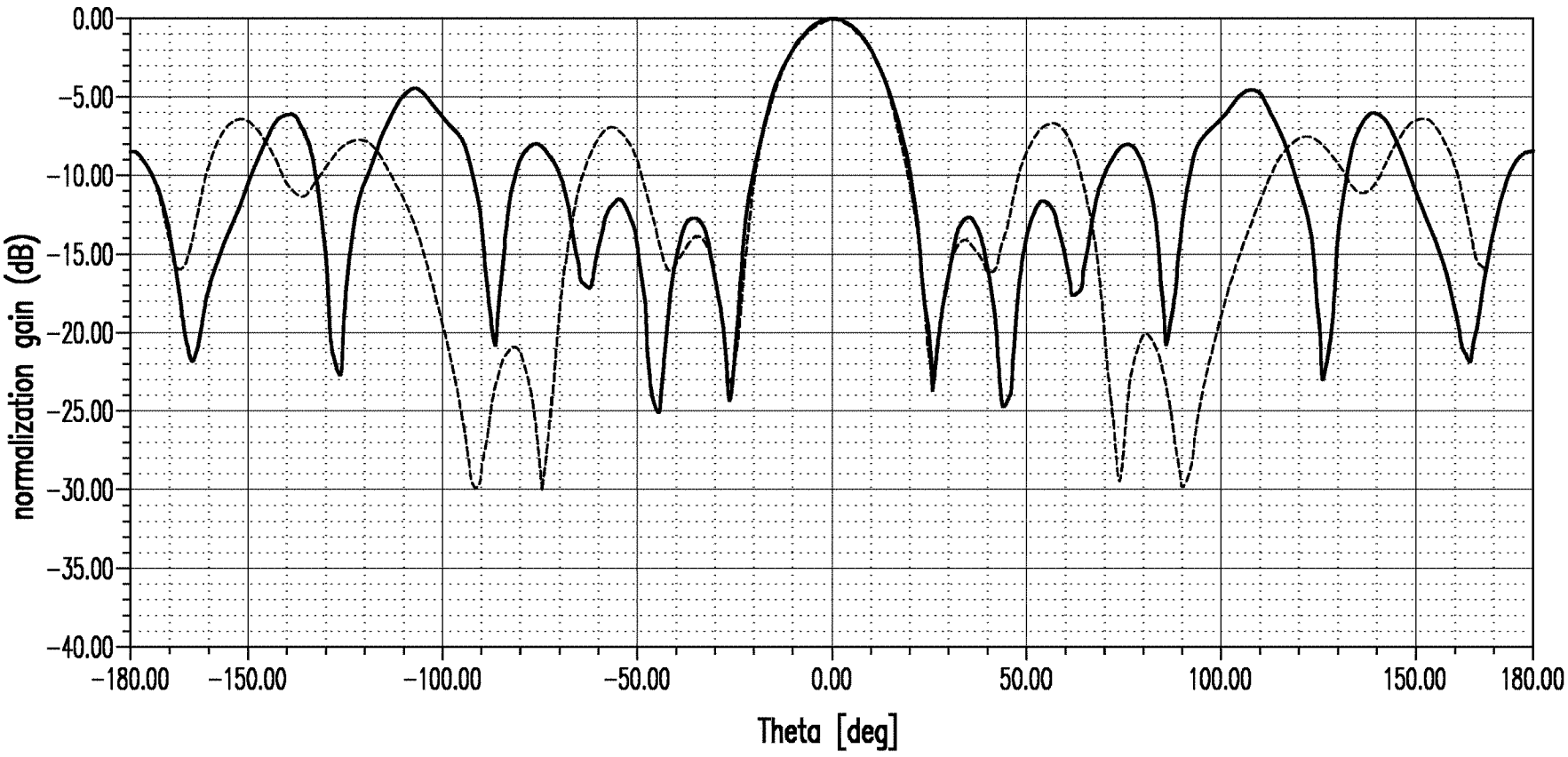
FIG. 11 is a horizontally and vertically polarized radiation pattern diagram illustrated according to an embodiment of the disclosure.

Please refer to FIG. 11. FIG. 11 is a horizontally and vertically polarized radiation pattern diagram illustrated according to an embodiment of the disclosure. In this embodiment, the impedance matching member 110, the field adjustment member 130, and the outer cover member 150 are assumed to be implemented by using non-metal materials with a dielectric coefficient of 16.2. It can be seen from FIG. 11 that in the case of using non-metal materials with a dielectric coefficient of 16.2 to implement the impedance matching member 110, the field adjustment member 130 and the outer cover member 150, the horizontally and vertically polarized patterns can still be symmetrical.

Figure 12A:
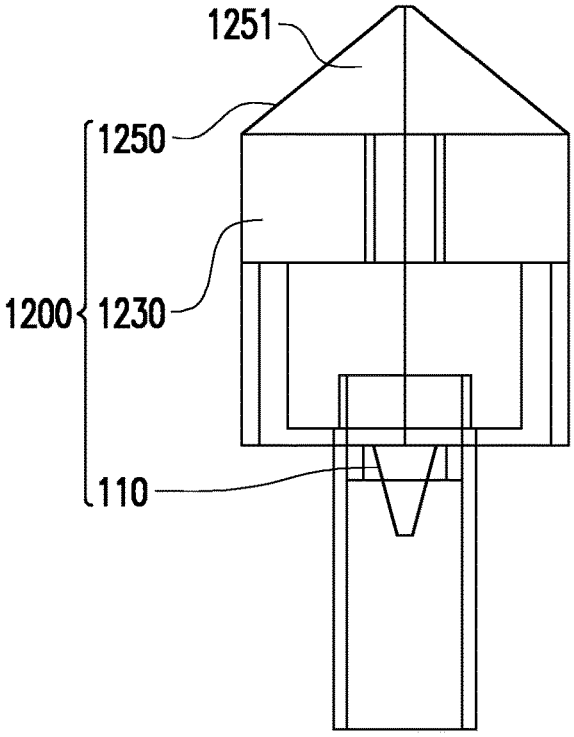
FIG. 12A is a side perspective view of an ultra-wideband non-metal horn antenna connected with a waveguide tube according to an embodiment of the disclosure.
Figure 12B:
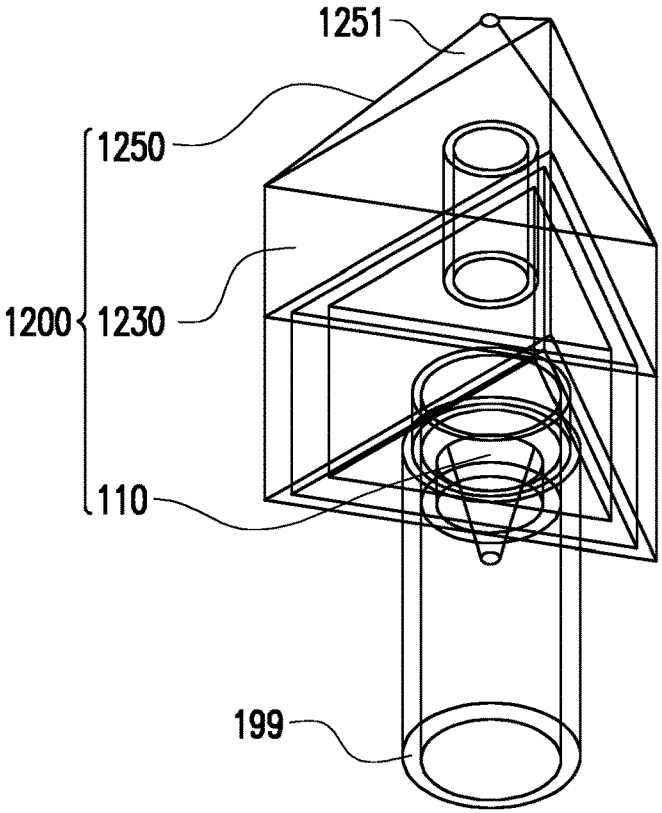
FIG. 12B is an oblique perspective view illustrated according to FIG. 12A.
Figure 12C:
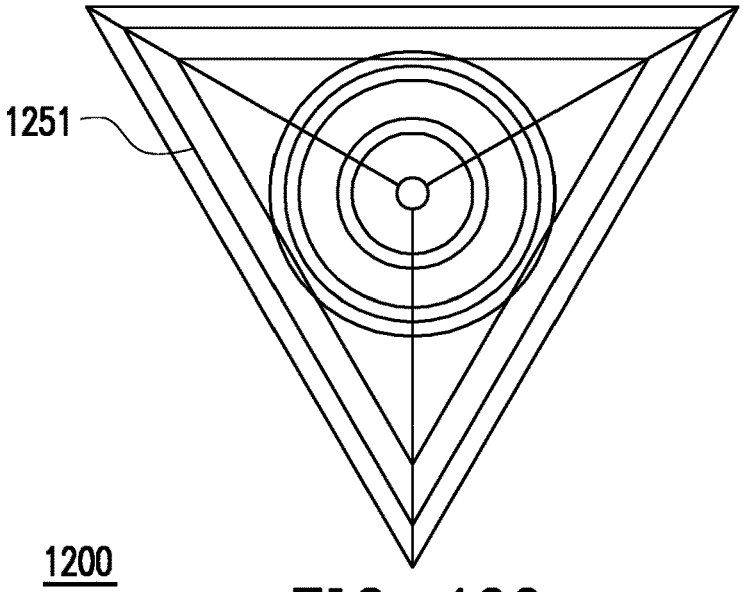
FIG. 12C is a top perspective view illustrated according to FIG. 12A.
Figure 12D:
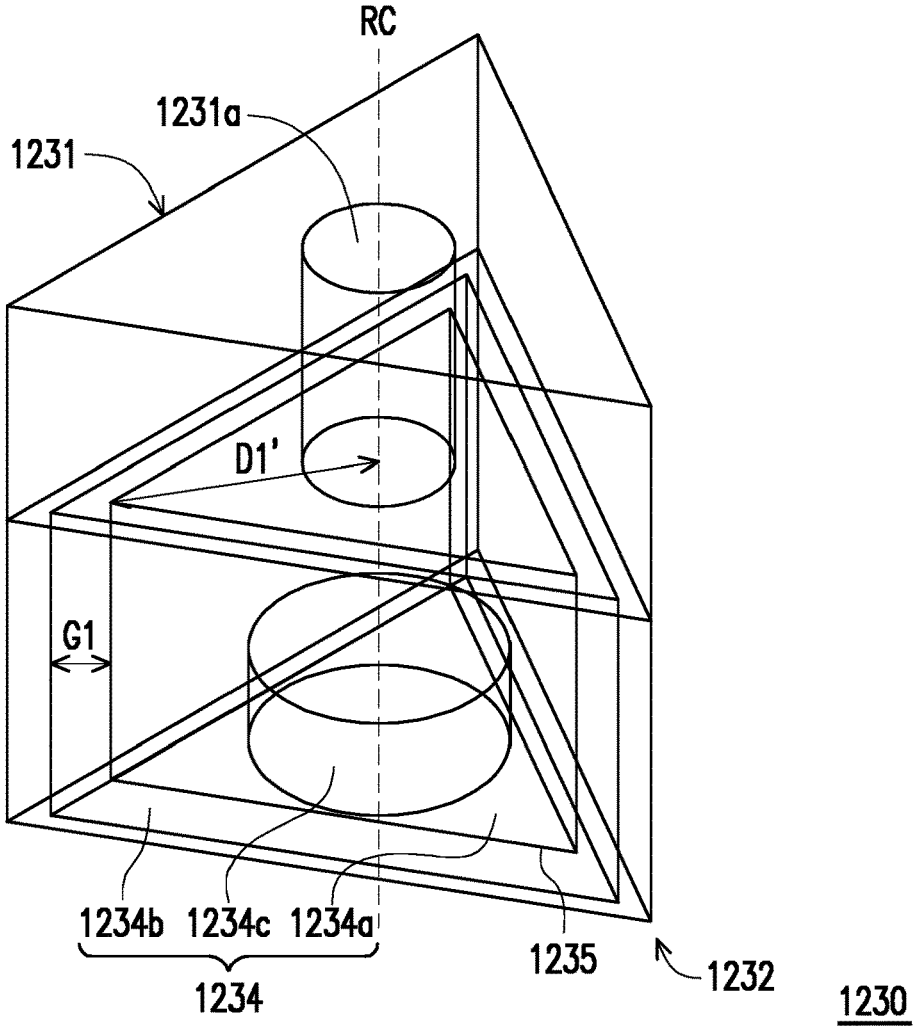
FIG. 12D is an oblique perspective view of the field adjustment member illustrated according to FIG. 12A.
Figure 12E:
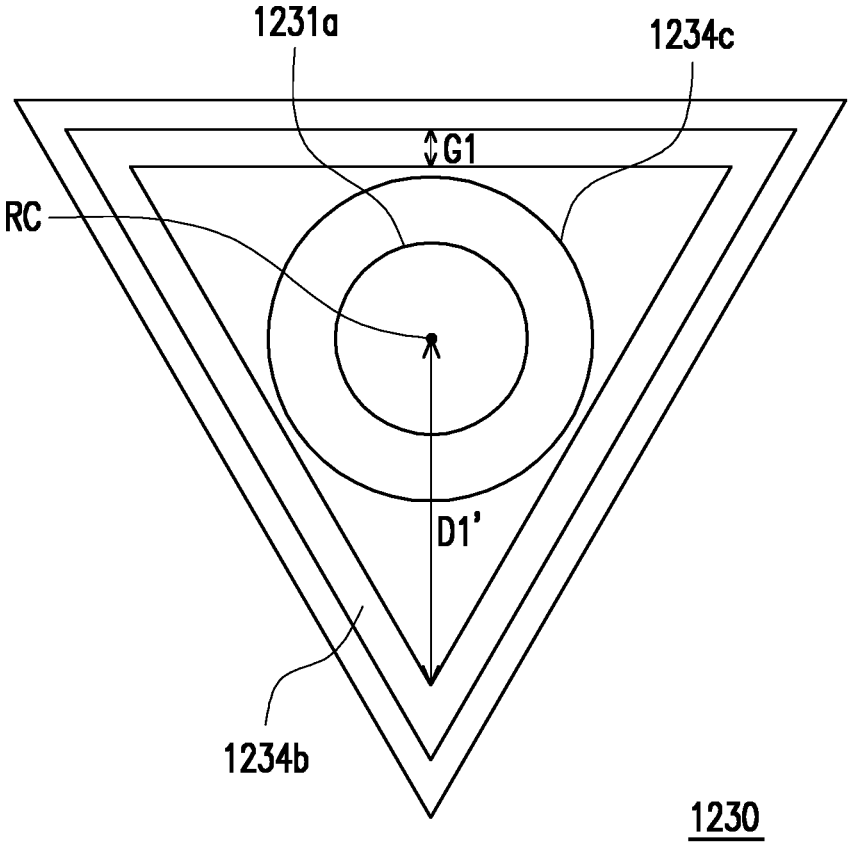
FIG. 12E is a top perspective view illustrated according to FIG. 12D.

Please refer to FIG. 12A to FIG. 12E. FIG. 12A is a side perspective view of an ultra-wideband non-metal horn antenna connected with a waveguide tube according to an embodiment of the disclosure. FIG. 12B is an oblique perspective view illustrated according to FIG. 12A. FIG. 12C is a top perspective view illustrated according to FIG. 12A. FIG. 12D is an oblique perspective view of the field adjustment member illustrated according to FIG. 12A. FIG. 12E is a top perspective view illustrated according to FIG. 12D. In this embodiment, the horn antenna 1200 of the disclosure includes an impedance matching member 110, a field adjustment member 1230, and an outer cover member 1250, wherein the field adjustment member 1230 is connected between the impedance matching member 110 and the outer cover member 1250, and the horn antenna 1200 is connected to the waveguide tube 199 through the impedance matching member 110.

As shown in FIG. 12A to FIG. 12E, in this embodiment, the field adjustment member 1230 may be an equilateral triangle angular columnar object, and the first tapered structure 1251 of the outer cover member 1250 may correspond to the field adjustment member 1230 and is designed as a cone-shaped object in the shape of equilateral triangle.

In this embodiment, the field adjustment member 1230 and the outer cover member 1250 are different from the field adjustment member 130 and the outer cover member 150 in appearance, in addition to that, other characteristics/structures of the field adjustment member 1230 and the outer cover member 1250 can be derived from the description related to the field adjustment member 130 and the outer cover member 150.

For example, the field adjustment member 1230 may include a first end 1231 and a second end 1232 opposite to each other. The end surface of the first end 1231 of the field adjustment member 1230 may be provided with a first trench structure 1231*a*, and the end surface of the second end 1232 of the field adjustment member 1230 may be provided with a second recessed structure 1234.

In this embodiment, the second recessed structure 1234 may include a second protruding portion 1234*a* and a second groove structure 1234*b* surrounding the second protruding portion 1234*a*, wherein the second protruding portion 1234*a* is, for example, a triangular columnar object, and the second groove structure 1234*b* is, for example, a triangular groove surrounding the second protruding portion 1234*a*. In addition, the top surface 1235 of the second protruding portion 1234*a* may be provided with a second trench structure 1234*c* corresponding to the first tenon portion 111*a* of the impedance matching member 110.

In this embodiment, the first tenon portion 111*a* of the impedance matching member 110 can be inserted into the second trench structure 1234*c* of the field adjustment member 1230, so that the impedance matching member 110 can be connected to the field adjustment member 1230 in the manner shown in FIG. 12A to FIG. 12C. In addition, in order to enable the first tenon portion 111*a* to be inserted and fixed in the second trench structure 1234*c*, the size of the first tenon portion 111*a* can be designed to correspond to the second trench structure 1234*c*.

In some embodiments, the impedance matching member 110 and the field adjustment member 1230 may be formed integrally, but may not be limited thereto.

In this embodiment, the form of the second groove structure 1234*b* can be adjusted to improve the radiation pattern of the horn antenna 1200, thereby making the horizontally polarized and vertically polarized patterns more symmetrical, and achieve the effect of narrow beams. For example, the width G1 of the second groove structure 1234*b* may be between 0.5 mm and 0.4 times the specific wavelength. In addition, the horn antenna 1200 may have, for example, a reference centerline RC, and the shortest distance (for example, the distance D1') between any angular column side of the second protruding portion 1234*a* (for example, a regular triangular column) and the reference centerline RC may be 0.5 times the diameter D1 in FIG. 5A, but the disclosure is not limited thereto. For other related details, please refer to the description of the field adjustment member 130, and no further description will be incorporated herein.

In other embodiments, those with ordinary knowledge in the art should be able to directly and unambiguously infer from the above-mentioned embodiments the specific structure and related structural parameters of the correspondingly formed horn antenna when the field adjustment member and the first tapered structure of the disclosure are respectively designed as regular N-sided angular columnar objects and regular N-sided angular pyramidal objects.

In summary, the horn antenna of the disclosure can be formed by combining three non metal elements, including impedance matching member, field adjustment member, and outer cover member. By designing the first groove structure in the impedance matching member, the horn antenna of the disclosure can achieve the effect of impedance matching. By setting the second groove structure in the field adjustment member, the horn antenna of the disclosure can have a more symmetrical radiation pattern (that is, the horizontally polarized pattern is symmetrical to the vertically polarized pattern) and a smaller antenna size.

In different embodiments, the above three non-metal elements can be implemented by using the same non-metal material (for example, a material with a dielectric coefficient between 2 and 16). In addition, the above three non-metal materials can also be realized by adopting non metal materials with different dielectric coefficients to further reduce the size of the antenna and avoid the problem of poor shrinkage. In addition, the waveguide tube can also be realized as a non-metal material sputtered with a metal layer on the outer layer, so as to achieve the effect of low cost and light weight.

Through experiments, the horn antenna of the disclosure can be applied to satellite communications, fifth-generation (5G) millimeter wave communications, antenna pattern measurement, and other antenna application technologies that require high gain and narrow beams.

What is claimed is:

1. An ultra-wideband non-metal horn antenna, comprising:

an impedance matching member comprising a first end and a second end opposite to each other, wherein the first end of the impedance matching member comprises a first tenon portion of the impedance matching member, and an end surface of the second end of the impedance matching member is provided with a first recessed structure, wherein the first recessed structure comprises a first protruding portion and a first groove structure surrounding the first protruding portion;

a field adjustment member, which comprises a first end and a second end opposite to each other, wherein an end surface of the first end of the field adjustment member is provided with a first trench structure of the field adjustment member, and an end surface of the second end of the field adjustment member is provided with a second recessed structure, wherein the second recessed structure comprises a second protruding portion and a second groove structure surrounding the second protruding portion, and a top surface of the second protruding portion is provided with a second trench structure of the field adjustment member corresponding to the first tenon portion, and the first tenon portion of the impedance matching member is inserted into the second trench structure of the field adjustment member; and an outer cover member, which comprises a first tapered structure and a second tenon portion corresponding to the first trench structure, wherein the first tapered structure comprises a vertex angle and a bottom surface, the second tenon portion of the outer cover member is connected to the bottom surface of the first tapered structure, and the second tenon portion of the outer cover member is inserted into the first trench structure of the field adjustment member.

2. The ultra-wideband non-metal horn antenna according to claim 1, wherein the first protruding portion is a second tapered structure, and a height of the first protruding portion is greater than a depth of the first groove structure.

3. The ultra-wideband non-metal horn antenna according to claim 2, wherein the ultra-wideband non-metal horn antenna is configured to provide a radiation signal with a specific wavelength, the height of the first protruding portion is less than the specific wavelength, and the depth of the first groove structure is less than half of the specific wavelength.

4. The ultra-wideband non-metal horn antenna according to claim 2, wherein the first protruding portion has a vertex angle extending outward, and the vertex angle of the first protruding portion is between 13 degrees and 45 degrees.

5. The ultra-wideband non-metal horn antenna according to claim 1, wherein the impedance matching member is connected to a waveguide tube through the second end of the impedance matching member.

6. The ultra-wideband non-metal horn antenna according to claim 5, wherein the waveguide tube and the impedance matching member are formed integrally.

7. The ultra-wideband non-metal horn antenna according to claim 5, wherein the waveguide tube is made of a non-metal material, and an outer layer of the waveguide tube is sputtered with a metal layer.

8. The ultra-wideband non-metal horn antenna according to claim 1, wherein the impedance matching member and the field adjustment member are formed integrally, or the impedance matching member, the field adjustment member and the outer cover member are formed integrally.

9. The ultra-wideband non-metal horn antenna according to claim 1, wherein a difference between a height of the first tenon portion of the impedance matching member and a depth of the second trench structure of the field adjustment member is less than 0.5 mm.

10. The ultra-wideband non-metal horn antenna according to claim 1, wherein the ultra-wideband non-metal horn antenna is configured to provide a radiation signal with a specific wavelength, the second protruding portion is cylindrical, and a diameter of an end surface of the second protruding portion is between 1.1 and 2 times the specific wavelength.

11. The ultra-wideband non-metal horn antenna according to claim 10, wherein a depth of the second recessed structure is between 0.8 times and 1.5 times the specific wavelength.

12. The ultra-wideband non-metal horn antenna according to claim 10, wherein a width of the second groove structure is between 0.5 mm and 0.4 times the specific wavelength.

13. The ultra-wideband non-metal horn antenna according to claim 10, wherein the second recessed structure has a top surface and a bottom surface, the bottom surface of the second recessed structure is connected to the second protruding portion, a height difference between the top surface of the second recessed structure and the top surface of the second protruding portion is less than 0.4 times the specific wavelength.

14. The ultra-wideband non-metal horn antenna according to claim 13, wherein the second recessed structure further comprises an inner annular surface, and an included angle between the inner annular surface of the second recessed structure and the bottom surface of the second recessed structure is between 80 degrees and 100 degrees.

15. The ultra-wideband non-metal horn antenna according to claim 13, wherein the second protruding portion has an outer annular surface, and an included angle between the bottom surface of the second recessed structure and the outer annular surface of the second protruding portion is between 80 degrees and 100 degrees.

16. The ultra-wideband non-metal horn antenna according to claim 1, wherein the second groove structure is a circular structure or a polygonal structure other than a regular triangle.

17. The ultra-wideband non-metal horn antenna according to claim 1, wherein the vertex angle of the first tapered structure is between 90 degrees and 120 degrees.

18. The ultra-wideband non-metal horn antenna according to claim 1, wherein the first tapered structure is a cone structure or a regular polygonal cone structure.

19. The ultra-wideband non-metal horn antenna according to claim 1, wherein the impedance matching member, the field adjustment member and the outer cover member are all made of non-metal materials.

20. The ultra-wideband non-metal horn antenna according to claim 1, wherein the field adjustment member is a regular N-sided angular columnar object, and the first tapered structure is a regular N-sided angular pyramidal object, where N is a positive integer greater than or equal to 3.

* * * * *